US008038522B2

(12) United States Patent
Thomas et al.

(10) Patent No.: US 8,038,522 B2
(45) Date of Patent: Oct. 18, 2011

(54) SPIN KENO

(75) Inventors: Alfred Thomas, Las Vegas, NV (US); Duncan F. Brown, Grayslake, IL (US); Lawrence E. DeMar, Winnetka, IL (US); Scott D. Slomiany, Streamwood, IL (US)

(73) Assignee: Case Venture Management, LLC, Northbrook, IL (US)

( * ) Notice: Subject to any disclaimer, the term of this patent is extended or adjusted under 35 U.S.C. 154(b) by 1560 days.

(21) Appl. No.: 10/090,685

(22) Filed: Mar. 5, 2002

(65) Prior Publication Data

US 2003/0073480 A1 Apr. 17, 2003

Related U.S. Application Data

(60) Provisional application No. 60/291,530, filed on May 16, 2001.

(51) Int. Cl.
*A63F 3/00* (2006.01)

(52) U.S. Cl. ..... 463/18; 273/138.1; 273/139

(58) Field of Classification Search ..... 273/274, 273/292, 138.1, 139; 463/10–13, 16, 18, 463/19

See application file for complete search history.

(56) References Cited

U.S. PATENT DOCUMENTS

| | | | | |
|---|---|---|---|---|
| 5,401,024 | A * | 3/1995 | Simunek | 463/18 |
| 5,697,843 | A | 12/1997 | Manship et al. | 463/20 |
| 5,848,932 | A | 12/1998 | Adams | 463/20 |
| 6,149,156 | A * | 11/2000 | Feola | 273/292 |
| 6,174,235 | B1 * | 1/2001 | Walker et al. | 463/25 |
| 6,190,255 | B1 | 2/2001 | Thomas et al. | 463/20 |
| 6,315,660 | B1 | 11/2001 | DeMar et al. | 463/16 |
| 6,702,671 | B2 * | 3/2004 | Tarantino | 463/20 |

FOREIGN PATENT DOCUMENTS

| | | | |
|---|---|---|---|
| EP | 874 337 | A1 | 10/1998 |
| EP | 926 645 | A2 | 6/1999 |
| EP | 945 837 | A2 | 9/1999 |
| EP | 984 407 | A2 | 3/2000 |
| EP | 984 408 | A2 | 3/2000 |
| EP | 989 531 | A2 | 3/2000 |

OTHER PUBLICATIONS

Monopoly Poker Edition Game, website article: http://www.mikohn.com/products/table_games/Monopoly/Poker.com, Dec. 14, 2001, (4 pages submitted).

How to Play Scrabble website: http://www.wmsgaming.com/products/video/scr/howto.html, Jan. 18, 2002, (one page submitted).

SlottoGame, described in AC Coin & Slot brochure,2000, p. 9, (10 pages submitted).

Monopoly Blackjack Edition Game, described in Mikohn brochure, 2000.

(Continued)

*Primary Examiner* — Vishu K. Mendiratta

(74) *Attorney, Agent, or Firm* — McDonnell Boehnen Hulbert & Berghoff LLP

(57) ABSTRACT

Apparatus and method for playing a Keno type game. The game consists of a plurality of elements, wherein a player specifies the number of game elements (such as the number of stop positions in a reel-type gaming machine), in the same way that the player would decide how many numbers to bet on a Keno game.

27 Claims, 15 Drawing Sheets

OTHER PUBLICATIONS

Monopoly Blackjack Edition Game, website article: http://www.mikohn.com/products/table_games/Monopoly_Blackjack.com, Dec. 14, 2001.

Live traditional keno games seen in various casinos, dates and places unknown, detailed description included in accompanying IDS.

Scratch and play game cards as sold by state lotteries, dates and places unknown, detailed description included in accompanying IDS.

* cited by examiner

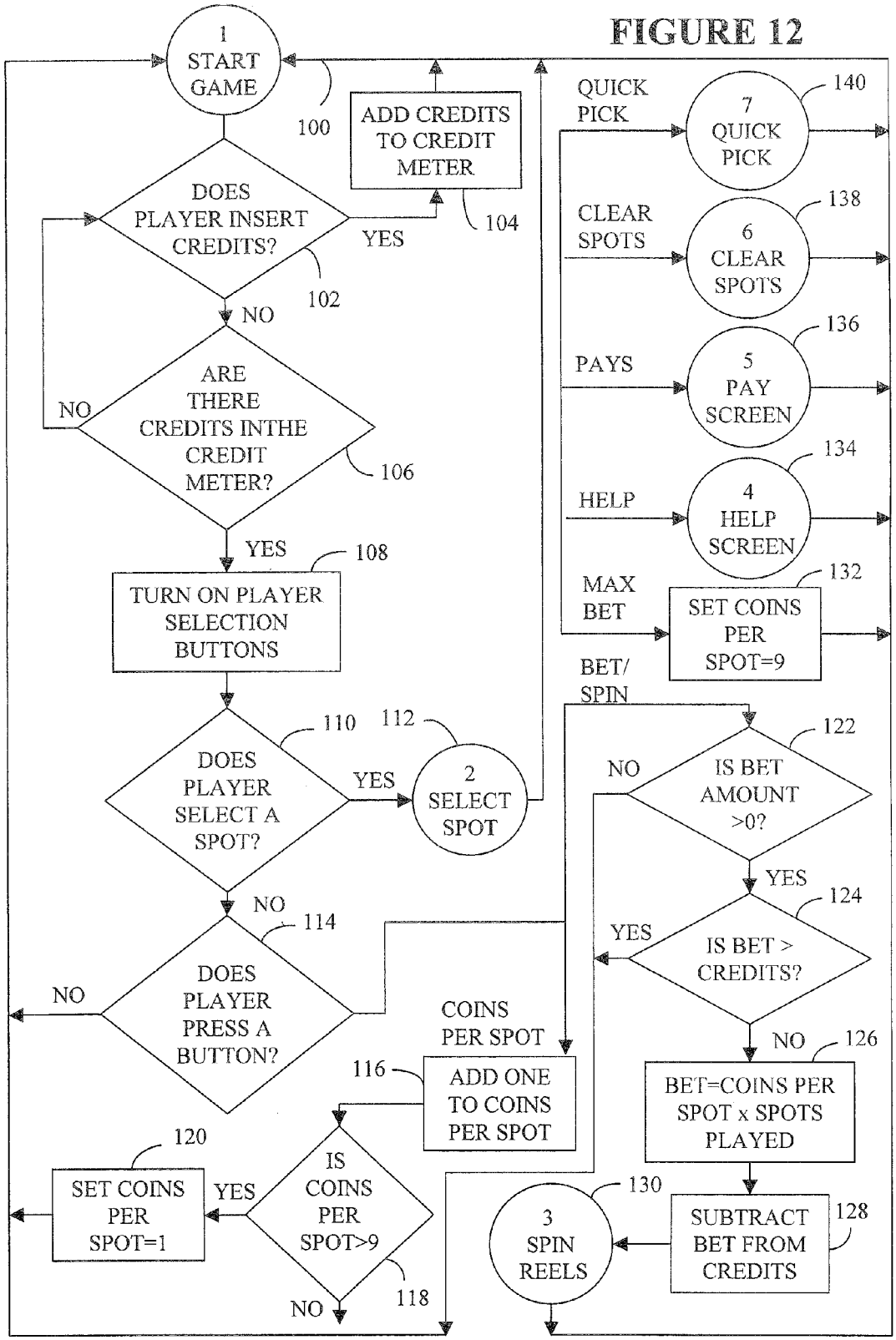
FIGURE 12
1 START GAME
100
ADD CREDITS TO CREDIT METER
104
DOES PLAYER INSERT CREDITS?
102
YES
NO
ARE THERE CREDITS INTHE CREDIT METER?
106
NO
YES
TURN ON PLAYER SELECTION BUTTONS
108
DOES PLAYER SELECT A SPOT?
110
YES
2 SELECT SPOT
112
NO
DOES PLAYER PRESS A BUTTON?
114
NO
COINS PER SPOT
ADD ONE TO COINS PER SPOT
116
IS COINS PER SPOT>9
118
YES
SET COINS PER SPOT=1
120
NO
QUICK PICK
7 QUICK PICK
140
CLEAR SPOTS
6 CLEAR SPOTS
138
PAYS
5 PAY SCREEN
136
HELP
4 HELP SCREEN
134
MAX BET
SET COINS PER SPOT=9
132
BET/ SPIN
IS BET AMOUNT >0?
122
NO
YES
IS BET > CREDITS?
124
YES
NO
BET=COINS PER SPOT x SPOTS PLAYED
126
SUBTRACT BET FROM CREDITS
128
3 SPIN REELS
130

SPIN KENO

CROSS REFERENCE TO RELATED APPLICATIONS

The present application claims benefit of a prior provisional U.S. Patent Application No. 60/291,530 entitled Spin Keno filed on May 16, 2001.

FIELD OF THE INVENTION

This invention relates generally to an apparatus and method for playing a game of chance, and more particularly to an apparatus and method for playing a new Keno-style wagering game.

DESCRIPTION OF THE PRIOR ART

As noted above, this invention generally relates to games of chance, such as for pure amusement as on devices such as a home (personal) computer or a home game console, hand-held game players (either dedicated or generic, such as Game Boy®[1]), coin-operated amusement devices, as well as for live games and gaming machines in a wagering environment, such as in a casino or Internet setting format.

[1] Game Boy is a registered trademark of Nintendo of America Inc.

Although the present invention has its genesis in the video gaming machine environment, and it will be particularly discussed with respect to embodiments in that arena, it will be understood that this is but one application of the invention, and the inventive concepts have much broader scope.

So said, traditional slot machines have a plurality of mechanical reels or drums, which "rotate" (either through actual movement of reels or video illustrations of moving reels) and then stop to show symbols, typically on one or more paylines drawn across the reels. Players wager coins or credits on one or more of these paylines, and are paid for certain combinations of symbols on a payline for which a wager has been placed. In certain slot machines, there may be combinations of symbols (also referred to as indicia herein) that pay the player that are not necessarily confined to paylines, such as so-called scatter pays, which may be awarded when certain symbols appear in any visible position, perhaps also restricted to certain reels. Video slot machines offer these same types of features, and often add in a bonus game that occurs when a game results in a particular symbol combination or some other triggering event.

In a typical multi-line slot machine, each line that is wagered upon uses the same or similar pay schedule. Multiple chances for the symbols to land in a paying combination are provided. However, each payline played is treated in essence as its own independently played game.

Keno is another well-known wagering game. In a typical Keno game, a player selects between one and fifteen numbers in the range of one to eighty. The game is played by randomly selecting some of the eighty possible numbers. It is customary to draw twenty numbers at random as the winning numbers. In "live" Keno games, this is usually accomplished using air blown ping-pong balls with one ball representing each of the possible eighty numbers. There is usually a separate paytable for each quantity of numbers played. That is, a particular paytable with pay values is used when fifteen numbers are chosen that, for example, will pay the player whenever six or more of the selected numbers are drawn. A different paytable would be used for ten numbers chosen, which may pay the player whenever five or more of the selected numbers are drawn, and so on. The paytables usually increase in pay value for the more matching numbers that are drawn.

Unlike a slot machine, Keno gives the player the ability to influence the outcome of the game, or at least the perception of some influence. That is, the player's winning or losing is dependent on whether the player selects the number or numbers that are ultimately chosen (by ping-pong balls, random number generator, or other selection process). While the probability or odds of winning are not affected by the player's input, this connection to winning or losing as a result of the player's selection is a very attractive feature to many players.

Another attractive feature of Keno is the result of the extremely low probability of hitting a high quantity of selected numbers (such as thirteen or more out of fifteen selected numbers). This very low probability allows very high awards to be possible, enticing play for a big payoff.

Virtually all reel-type slot machines today (mechanical or video) are based on three, four or five reels. Until now, adding more reels caused the probability of hitting the longest combinations to be far too low. At the same time, it created very long and confusing paytables.

SUMMARY OF THE INVENTION

When we set out to make the present invention, and then in the course of developing the invention, we had a number of objectives in mind, which we consider that the present invention accomplishes, as disclosed hereafter.

It was one such objective of our inventive effort to create a slot-type machine with an abundance of reels, where a player can select which reels that will be used for determining an outcome of a "spin", just like numbers are selected in a Keno game. In keeping with that objective, the player can specify the number of reels involved in the outcome in the same way that a player would decide how many numbers to bet on a Keno game. Another collateral objective we had was that each possible number of reels employs a different paytable. The player selects certain reels (or "spots", or game element locations, as sometimes referred to herein) from a larger number of reels as the gameplay elements to base the outcome upon. The more reels or spots that the player selects, the higher the possible payouts.

Another object of the invention was to provide a gaming machine that has an exciting quick symbol selection process utilizing a reel-type arrangement, particularly with an attractive non-linear increasing payback scheme.

Still another object of this invention was to provide a game, as for a gaming machine, having an aggregation of independent events for a payout scheme based on these aggregate totals. Yet another related object of this invention is a slot machine that uses a different paytable for each possible maximum number of events, and to have the paytable increase in a non-linear fashion, such that as more winning events are achieved, the payoffs increase in a spiraling upward manner.

Yet another concept we had for the invention was to provide a slot machine without paylines, where the pays are based solely on the quantity of symbols achieved. This may be thought of alternatively as a slot machine where the player constructs his or her own paylines from the various possible positions where the symbols may stop. Paylines is used in a non-geometric sense here (since there may be no geometric "line" arrangement at all).

We also had another objective that, for every paying combination that does not use every reel or spot, there is another higher paying combination that uses additional reels or spots which contain the given paying combination. Still another objective along the same concept was to provide a method of playing a slot machine with many more than the three to five reels found on today's slot machines, with odds and a payout schedule that are more attractive to the player.

With such objectives in mind, and variously accomplishing these objectives as well as others, the present invention provides in one broad sense a method of playing a game comprising the steps of providing a game display having a plurality of game element locations, with the player selecting game element locations (spots, reels, etc.) in a number fewer than the number displayed. This is Keno-like in concept.

A set of game elements with differing indicia is used. Such indicia can be of any type, such as fruit, numbers, cartoons, etc. After the player selects the game element locations, a game element indicium is then randomly assigned to at least each selected game element location for a gameplay condition.

A determination according to a preset methodology is then made as to whether the randomly assigned game element indicia represent a winning outcome in the gameplay condition. While it is possible to play our game with only one selection by the player (and the step of selection of game element "locations" is meant to include one or more unless otherwise evident), the preferred embodiments use a plurality of player selections. This enables, among other things, a methodology that includes matches of identical indicia (two or more cherries, three lemons, lemons and a wild symbol, and so on), as well as some other kind of organizational or associative matching (e.g., two or more of any kind of fruit, a plurality of fish, and the like). "Matching" indicia is therefore used broadly in this sense.

The invention can have the random assignment of game elements drawn from all of the game elements of the set for each said selected game element location. That is, it is "repeated" from the full set for each selection. Alternatively, a single set of game elements to be drawn upon could include subsets of matching game elements (multiples of the same/similar indicium), and the random assignment of game elements involves only that set as a whole for a given gameplay. Think of this as a set of ping-pong balls where there are repeating numbers on the balls.

In certain embodiments, the game display is a matrix of rows and columns defining the game element locations. One such preferred embodiment has the random assignment of game elements provided in the form of a spinning reel presentation for at least each selected game element location; all the reels need not spin, although that is considered most desirable from at least a visual standpoint. Each reel, when spun, reveals a randomly assigned game element for a respective game element location in a reel-stop position. This reel-type embodiment can be either a mechanical reel-type apparatus, or a video machine, or some combination of the two. The "spinning" of a reel thus encompasses a real reel or a virtual (video) representation; it need not even be presented as moving in the video version (simply appearing without the illusion of rotation of the reel), although the movement is more desirable. The aforementioned reel-stop position and random assignment of an indicium would therefore be a rotation of an actual reel with the various indicia thereon, which then comes to a halt at a randomly arrived at stopping point, or an indicium that is first determined by a random number generator (RNG), and then displayed at a respective game element location.

The foregoing embodiment advantageously uses an awards table which has an award of increasing value for the winning outcome based upon the aggregate number of matching indicia in the gameplay condition. That preferably includes a hierarchy of values based upon the type of indicium, such that certain indicium yield a greater award for the same aggregate number of matches (e.g., bells are worth more than cherries).

In another aspect of the invention, the random assignment of game elements occurs for all of the game element locations (e.g., reels) for a gameplay condition, and the methodology further includes predetermined spatial arrangements of indicia in a matrix which also represent a winning outcome in the gameplay condition. That is, for instance, spatial arrangements including horizontal, vertical and diagonal linear predetermined associations of indicia would yield an award in addition to the aggregate number of matches. This would be a more traditional slot-type game that operates in conjunction with the Keno-type game described above.

Another aspect of the invention includes a plurality of paytables, with paytables being of increasing values one paytable to the next. The game methodology applies a respective paytable according to the aggregate number of game element locations selected, i.e., as the more game element locations (reels in a preferred embodiment) are selected, a paytable having (at least some) higher values then applies. This increases the potential payout for an increasing wager, with the wager being based, in part, upon the aggregate number of game element locations selected, and a wagered amount per location.

As noted above, the invention is embodied as a game, a method of playing a game, and a gaming apparatus, such as for a slot-machine type game using a spinning reel visual presentation. In the latter form, again, reels may be either mechanical or video representations of reels. Either way, the reels each have a plurality of game indicia with at least some of the indicia being different from each other.

As a gaming machine, for instance, an operating system for the apparatus includes a processor, with the processor having a program effecting play of the game. The program has at least one and preferably more payout tables, and a "RNG subroutine". The operating system has a memory, among other standard features of a microprocessor-based gaming machine that are well known and understood in the art.

An input device through which a player provides a control input to the game apparatus (via mouse, touchscreen, buttons (real or virtual) and the like) is provided, along with a wagering input device (such as a coin/bill slot, card reader, etc.), and a payout device (coin discharge, credit slip printer, inter or intranet credit registration, and the like).

The operating system drives the display to present a plurality of game element locations, and registers a selection input by a player of game element locations. The program limits the selection to less than all of available game element locations (or alternatively, less than all of the available indicia). Once a wager input by the player upon an outcome of the game has also been registered, then the operating system determines a game element indicium to be displayed in at least the selected game element locations for a gameplay condition. The game element indicium to be applied to each location is randomly assigned from a set of differing game element indicia.

The indicium for each selected game element location is displayed, with a determination of an outcome being made based upon the gameplay condition. A payout, if any, is provided according to a winning condition being determined as established by the payout table (or tables). That payout is according to an award of increasing value based upon an aggregate number of matching indicia in the gameplay condition. It preferably also is based upon the aforementioned hierarchy of values predicated upon the type of indicium, such that certain indicium yield a greater award for the same aggregate number of matches.

These and other objectives and advantages achieved by the invention will be further understood upon consideration of the following detailed description of embodiments of the invention taken in conjunction with the drawings, in which:

BRIEF DESCRIPTION OF THE DRAWINGS

FIGS. 12 through 18 are flowcharts for a program operating an embodiment of the invention.

DETAILED DESCRIPTION OF PREFERRED EMBODIMENTS

The embodiments of the invention described hereinafter have been particularly adapted for play on a video display, and even more particularly, for play upon a video gaming machine. As noted above, the game could easily be adapted for play on a mechanical gaming machine without departing from the invention, or on a board or table, or any other conceivable environment where games are played. What is shown in FIG. 1 through FIG. 9 are representations of a monitor or screen of the video display of games at various exemplary moments.

Figure 1:
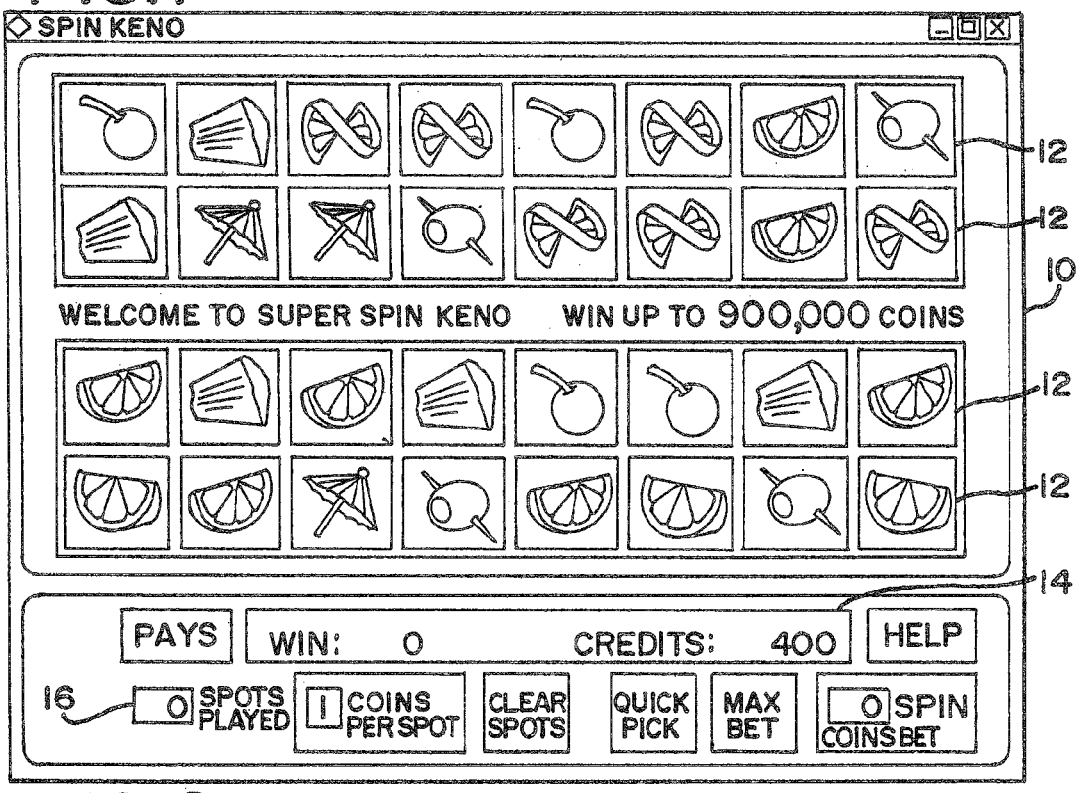
FIGS. 1 through 8 are screens from a video display showing one embodiment of the invention.

FIG. 1 shows an embodiment of the current invention implemented on a video gaming machine. In FIG. 1, there are thirty-two video slot reels 12 in a formation of four rows, each row containing eight reels on the display 10. More or fewer reels may be used without departing from the invention, and they may be in a different number of rows, or not in rows at all. The invention will work with any respective orientation of the various reels. Reels, of course, are only one way to present these game element locations.

Before playing the game in a wagering form, the player must establish credits on the machine through the insertion of money, voucher, credit ticket or electronic funds transfer, all as is well known in the art. The credits are then displayed on the "Credits" window meter 14. The machine also uses a payout hopper, payout ticket, electronic funds transfer mechanism or other mechanism (not shown in FIG. 1, but is shown in FIG. 10) well known in the art to pay out the award on the machine to the player, as at the player's request.

Using a mouse, touchscreen, trackball, button, or other pointing device, the player selects certain reels 12 for play. Mechanical pushbuttons may also be used for this selection purpose.

In this embodiment, the player may select from one to ten reels on which to place a bet. The number of reels selected is displayed on the "Spots Played" meter 16. The range of reels that the player may select can be modified by allowing greater or fewer than ten reels as the maximum number of reels that the player may select, or by allowing greater than one reel as a minimum without departing from the invention. Selection of only one reel might also conceivably be an option, but the aggregate matching of selections in the most desired game then takes on a much different form for a win from the embodiments specifically discussed herein.

Figure 2:
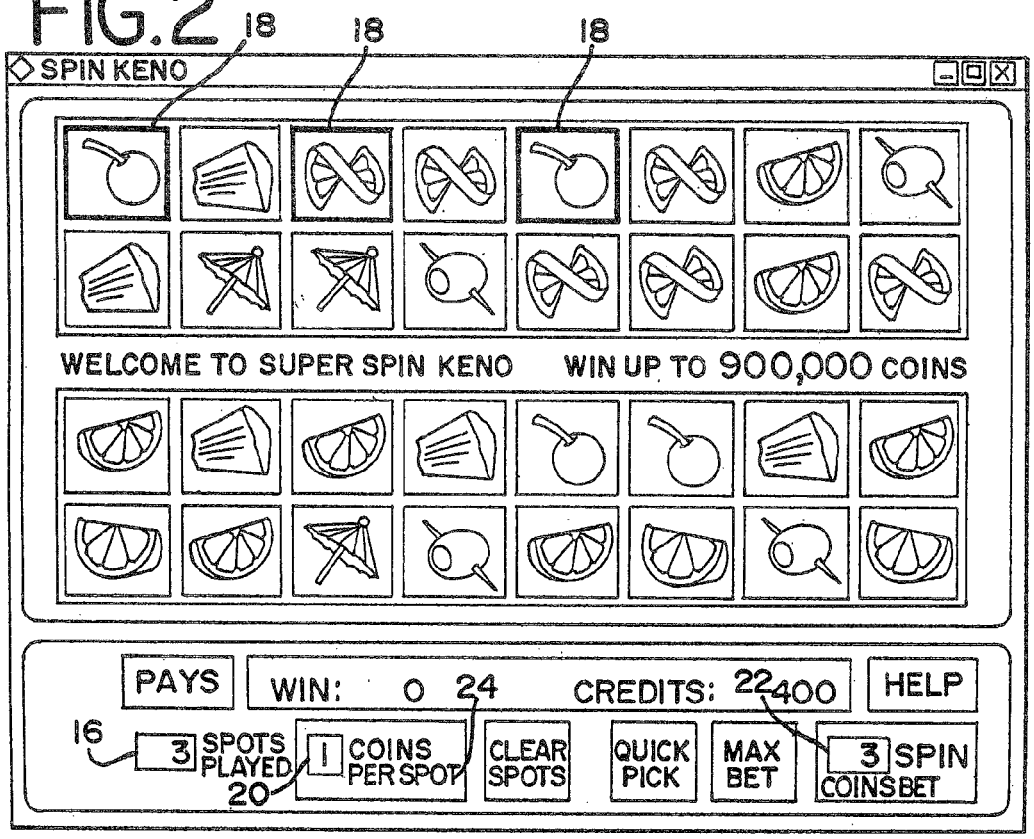

As shown in FIG. 2, when a reel is selected, it is highlighted with a ring around the symbol to show that it is a selected reel 18. If a reel that has already been selected is selected again, the machine causes that reel to become unselected (deselected), and the highlighted ring will disappear. FIG. 2 shows the game after three reels 18 have been selected (specifically the $1^{st}$, $3^{rd}$ and $5^{th}$ reels in the top row). The "Spots Played" meter 16 shows that 3 spots (or reels) are currently being played (or wagered upon).

A wager of one coin is required for each reel selected in this embodiment. This pricing scheme affects the paytables, as will be seen as the paytables are constructed. With appropriate paytable construction, the game could be designed using one coin for any number of spots, or different linking of coins-bet and spots-selected without departing from the invention. In FIG. 2, the "Coins Per Spot" meter 20 shows that one coin is bet for each reel or spot. The player may scale the bet upward using the "Coins Per Spot" button 24. In this embodiment, the player may bet one to nine coins per spot, however a different range may be used without departing from the invention. The "Coins Bet" meter 22 shows that a total of three coins are bet.

Figure 3:
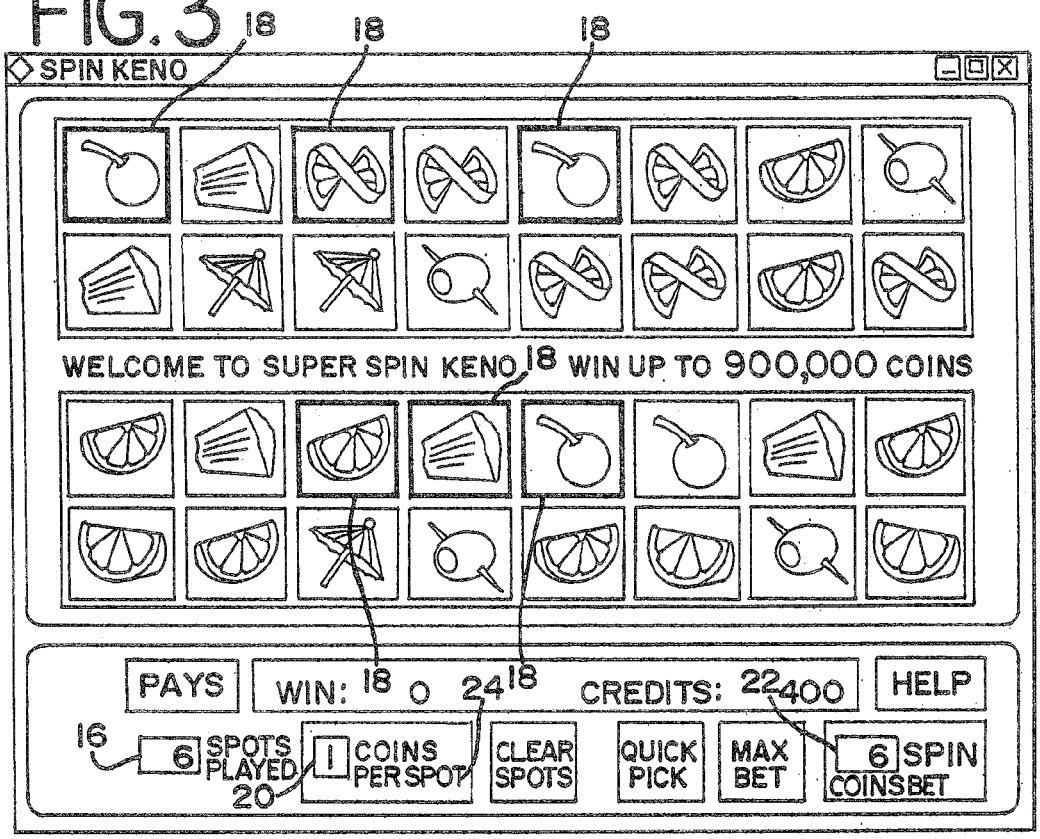

FIG. 3 shows the same screen from FIG. 2 after three additional reels 18 have been selected, specifically the third, fourth, and fifth reels on the third row have been selected in addition to the reels selected in FIG. 2. The "Spots Played" meter 16 now shows six spots played and the "Coins Bet" meter 22 now shows six coins bet.

Figure 4:
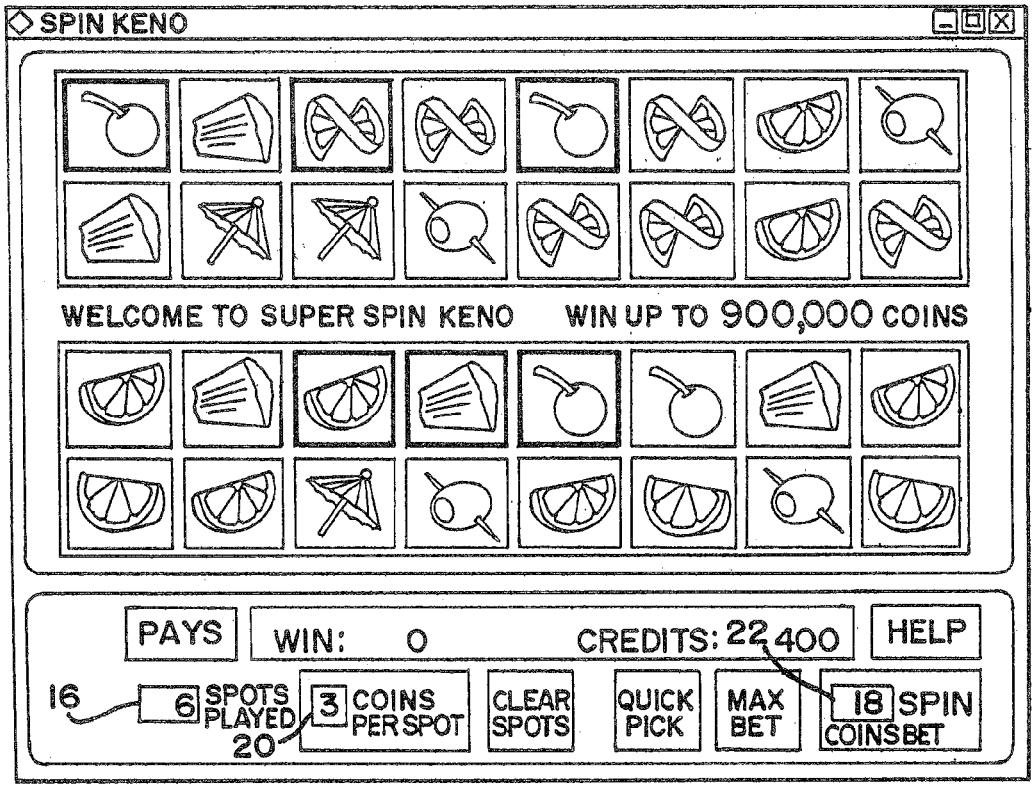

FIG. 4 shows the display after the "Coins Per Spot" meter 20 was set to 3. The total bet is the product of "Spots Played" meter 16 and "Coins Per Spot" meter 20, which in this case is 6×3=18 coins or credits as shown on the "Coins Bet" meter 22. All payouts are scaled by the "Coins Per Spot" bet, as is well known in the art.

It will be seen later that a separate paytable is used for each number of spots that are played. Thus, in this embodiment, which allows the player to select one to ten spots (or reels), there are ten separate paytables. The paytable for six reels played is shown in Table 1.

TABLE 1

| 6 Reels Played Paytable | |
|---|---|
| 6 Pineapples | 2000 |
| 5 Pineapples | 300 |
| 4 Pineapples | 75 |
| 3 Pineapples | 12 |
| 6 Olives | 2000 |
| 5 Olives | 300 |
| 4 Olives | 75 |
| 3 Olives | 12 |
| 6 Umbrellas | 1500 |
| 5 Umbrellas | 300 |
| 4 Umbrellas | 100 |
| 6 Oranges | 1000 |
| 5 Oranges | 200 |
| 4 Oranges | 50 |
| 3 Oranges | 9 |
| 6 Limes | 750 |
| 5 Limes | 100 |
| 4 Limes | 25 |
| 3 Limes | 9 |
| 6 Lemons | 750 |
| 5 Lemons | 100 |
| 4 Lemons | 25 |
| 3 Lemons | 9 |
| 6 Cherries | 750 |
| 5 Cherries | 100 |
| 4 Cherries | 25 |
| 3 Cherries | 9 |
| 2 Cherries | 3 |

The paytable has been designed so that four or more Umbrellas trigger a bonus game (or bonus round), which is why more Umbrellas are required as an initial threshold than any other symbol to obtain a payout. The values shown for the Umbrella combinations in the paytable represent the expected value (EV) of the bonus round. The independent development of a bonus round and use of its EV for the calculation of overall expected rate of return is well known by those skilled in the art. As stated above, all of the Table 1 pay values are multiplied by the value of the "Coins Per Spot" meter 20 when a game is played.

Figure 5:
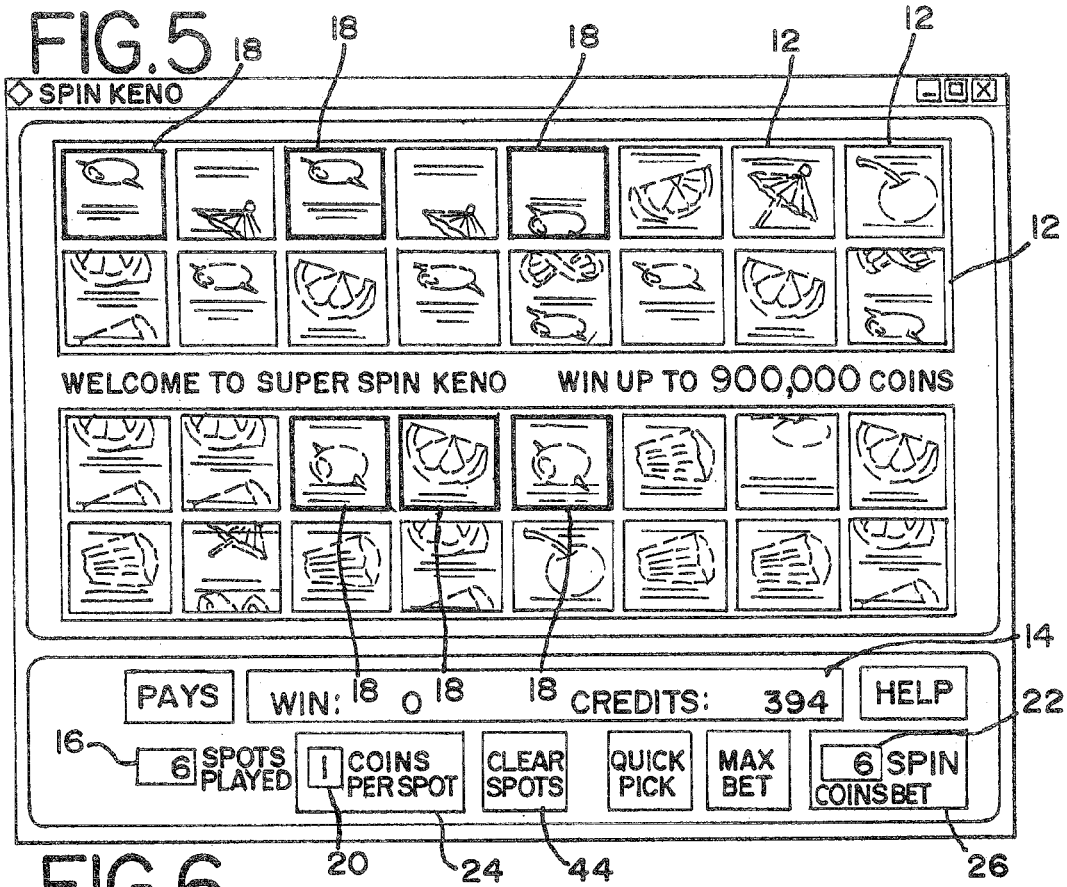

Once the bet and reel selections have been established as described above, the player may actuate a "Spin" button 26 as shown in FIG. 5. This may be in the form of any actuation devices mentioned previously. FIG. 5 shows the play of a spin wherein the player has continued to play the same spots as in FIGS. 3 and 4. Once the "Spin" button 26 is actuated, the game deducts the amount shown on the "Coins Bet" meter 22 from the "Credit" meter 14 and all thirty-two reels 12 begin to spin as shown in FIG. 5.

The spinning reels 12 are stopped in a pleasing sequence, as is well known in the art, although the reels 12 could be stopped in any manner without departing from the invention. In this embodiment, each of the thirty-two reels 12 stops showing a single symbol. The reels could show part or all of other symbols besides the centered symbol, again without departing from the invention. FIG. 5 also shows that once the reels 12 begin to spin, the selected reels 18 appear to be more brightly illuminated than the reels that were not selected. This enhancement, of course, is not required for the invention, but is desirable to allow the player to better focus on the reels selected.

Figure 6:
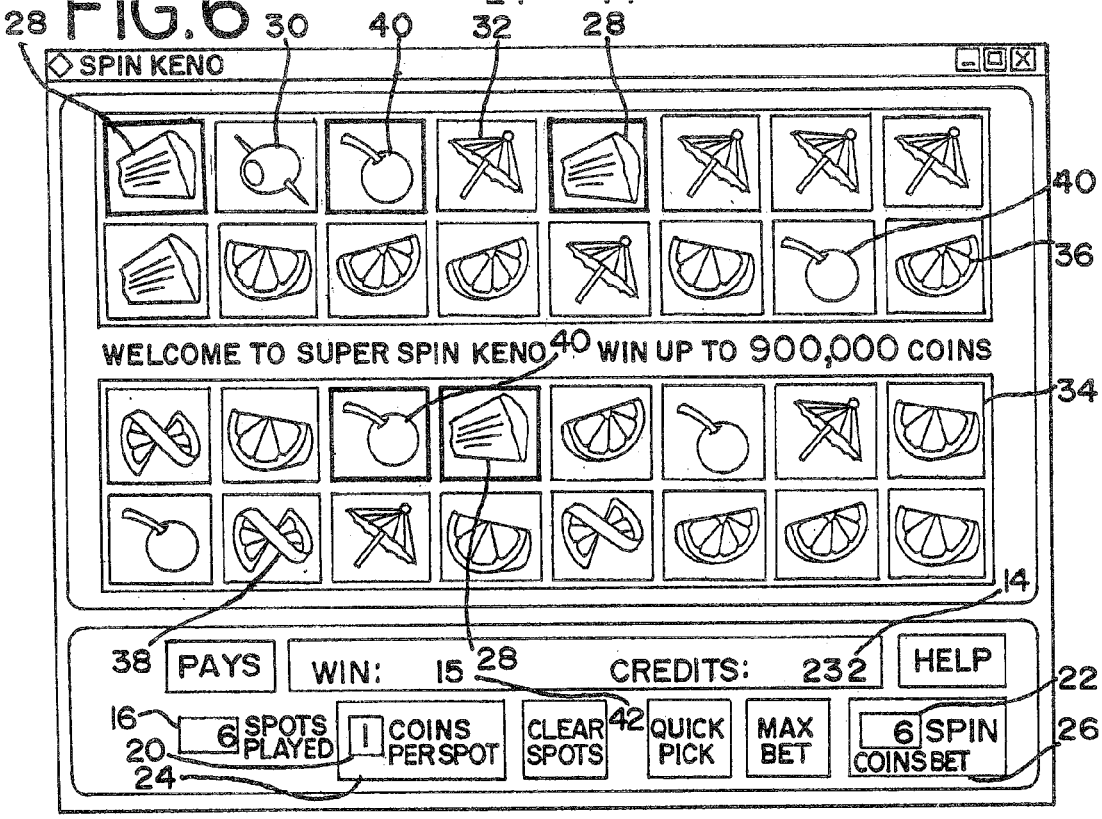

There are no paylines per se in this embodiment as described so far. As shown in FIG. 6, this embodiment uses seven different symbols, namely a Pineapple 28, an Olive 30, an Umbrella 32, an Orange 34, a Lime 36, a Lemon 38, and a Cherry 40. After the reels stop, the quantity of each symbol showing on the selected reels 18 (selected by the player) is totaled, and the player is paid for the highest quantity of each symbol based on the Table 1 paytable (when six reels are played as in this example). For example, if the six selected reels showed two Cherries, three Pineapples and a Lime (see FIG. 6), then the player would be paid twelve coins or credits for the three Pineapples plus three coins or credits for the two Cherries for a total of fifteen credits, all multiplied by the value of the "Coins Per Spot" meter 24.

After any spin, the gaming machine analyzes the symbols on the selected reels and makes the appropriate payments based on the appropriate paytable. The total win is shown on the "Win" meter 42 and added to the "Credits" meter 14. In one embodiment of the game, the reels contributing to the win total are highlighted. If more than one line from the paytable is paid on a given spin, then at the end of the spin all of the reels contributing to winning paytable lines will be highlighted for a short time, then the reels contributing to the winning paytable lines will be highlighted in sequence, stepping from one winning paytable line to the next.

Figure 7:
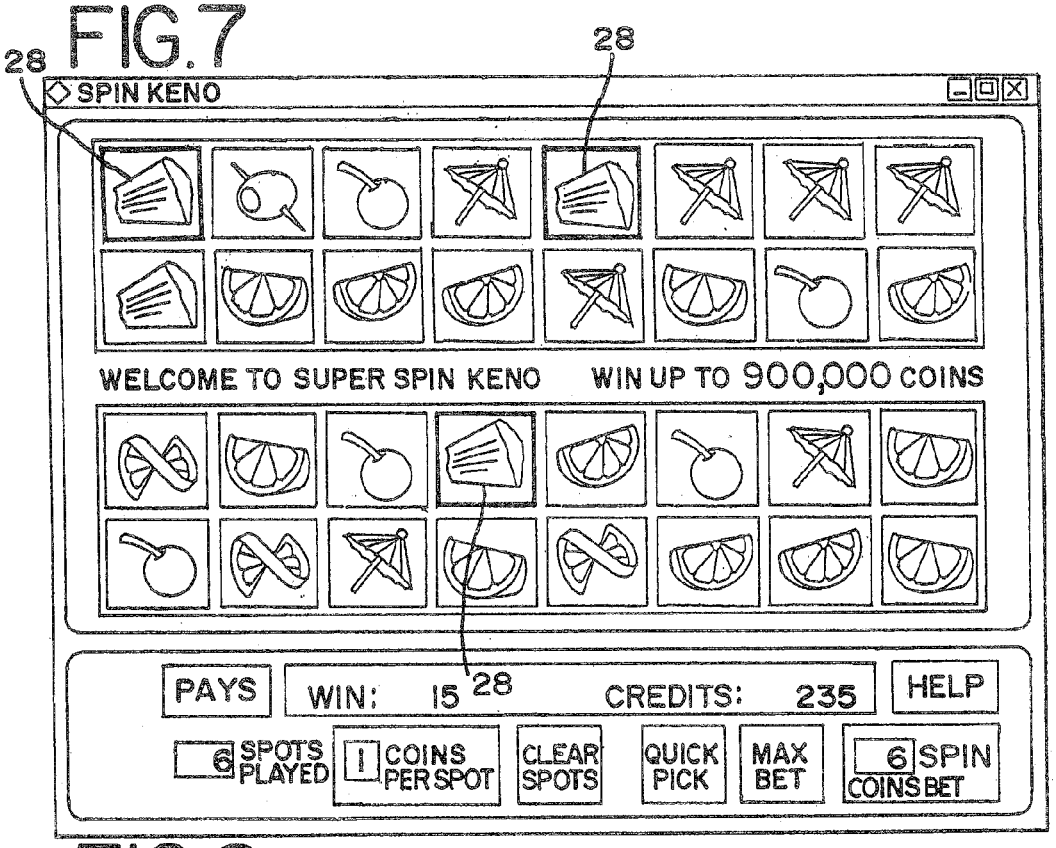
Figure 8:
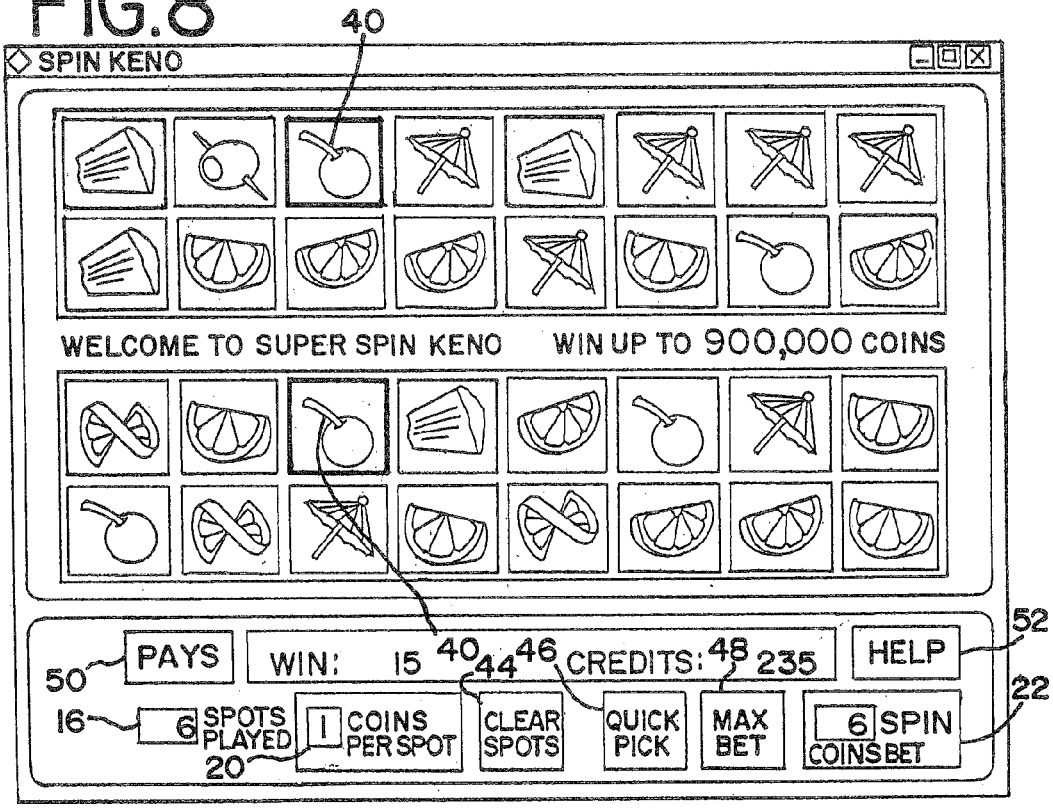

Shown in FIG. 6 is a winning display after a spin that contained three Pineapples 28 and two Cherries 40. All five reels containing Pineapples 28 and Cherries 40 are highlighted immediately following the spin to illustrate another type of winning display. FIG. 7 shows the game highlighting the three Pineapples 28, and FIG. 8 shows the game highlighting the two Cherries 40 to illustrate other ways of highlighting winning displays. These two wins could flash back in forth in this fashion. The game may call out the win amount for each combination as it is highlighted, just for one other example.

FIG. 8 also shows other buttons on the display or screen that the player may use to configure the amount of the bet and the number of reels to be played. There is a "Clear Spots" button 44, which will cause all reels to be unselected. Actuating this button removes all selections to allow the player to begin the selection process again. There is a "Quick Pick" button 46, which will clear all of the current selected reels and then randomly select the same number of reels from the thirty-two reels 12. In this embodiment, if there are no reels selected when the "Quick Pick" button is pressed (i.e., the "Spots Played" meter 16 will show "0") then the game will randomly pick the maximum reels to be selected for the available wager.

There is also a "Max Bet" button 48, which sets the "Coins Per Spot" meter 20 to nine coins, and updates the "Coins Bet" meter 22 accordingly. While the maximum bet allowed in this embodiment is ninety coins (ten reels selected times nine coins per spot), the "Max Bet" button 48 does not force ten reels to be bet upon, to preserve the reel selection made by the player. This button could nonetheless force ten reels without departing from the invention. The "Pays" button 50 allows the player to view the paytable. Recalling that there is a different paytable for each possible number of reels played, the paytable screen may contain buttons to allow the player to view the ten different paytables used in this embodiment on demand.

The "Help" button 52 is used to display a Help screen. It provides instructions to the player about the operation of the game.

Analysis of the Game

For each possible number of reels that may be selected by the player (one to ten reels in the one embodiment), a separate analysis of the game is done, which will yield a respective paytable for that number of reels selected.

Six Reels Selected

The following analysis is for the six-reel selection that has been used as an example above (FIGS. 3 through 8). In this embodiment, the identical reel layout is used for all thirty-two reels. That is, the probability of getting a specific symbol is the same on each of the thirty-two reels. This greatly simplifies the analysis of the game because the mathematical analysis and award frequency is independent of which reels are selected, because each reel has the same probability for each possible result. With a more complex analysis, the game could be designed with different symbol probability on different reels without departing from the invention.

Table 2 shows the reel strip frequency that is used on all thirty-two reels when six reels are selected by the player. In this embodiment, different reel strip frequencies are used when a different number of reels are selected. Of course, identical reel strip frequencies could be used for all possible selections of reels.

TABLE 2

Reel Strip Frequencies

| Symbol | Number of Occurrences | Probability |
|---|---|---|
| Pineapple | 1 | 0.142857 |
| Olive | 1 | 0.142857 |
| Umbrella | 1 | 0.142857 |
| Orange | 1 | 0.142857 |
| Lime | 1 | 0.142857 |
| Lemon | 1 | 0.142857 |
| Cherry | 1 | 0.142857 |
| Total | 7 | 1.0 |

For six selected reels with seven stop positions on each, the number of possible combinations of the reels is $7^6$ (7 raised to the $6^{th}$ power)=117,649. For each paytable line, one determines the number of occurrences of the symbol set required for the given pay. Unlike a traditional reel-type slot game where the symbols must occur in order from left to right, the symbols may appear on any set of the selected reels. The method used to total the occurrences is finding the number of occurrences where the required symbols occur on the first reels (as if they were required in order), and then multiplying that by the number of ways to get the specified number of symbols in a combination.

Table 3 shows a spreadsheet for analyzing the payout percentage when six reels are played. Working from the top of the paytable in Table 3, we first look at the number of occurrences of six Pineapples. The number of occurrences of six Pineapples on the first six reels is 1×1×1×1×1×1=1. This is shown in the second column of Table 3. The total number of occurrences of six Pineapples is the product of the second and third column and is shown as 1 in the fourth ("Occurrences") column.

TABLE 3

| Paying Combination | Occurrences With Symbols in First Reels | Ways to Make This | Occurrences | Probability | Pay | EV |
|---|---|---|---|---|---|---|
| 6 Pineapples | 1 | 1 | 1 | 8.49986E−06 | 2000 | 0.0028333 |
| 5 Pineapples | 6 | 6 | 36 | 0.000305995 | 300 | 0.0152997 |
| 4 Pineapples | 36 | 15 | 540 | 0.004589924 | 75 | 0.0573741 |
| 3 Pineapples | 216 | 20 | 4,320 | 0.036719394 | 12 | 0.0734388 |
| 6 Olives | 1 | 1 | 1 | 8.49986E−06 | 2000 | 0.0028333 |
| 5 Olives | 6 | 6 | 36 | 0.000305995 | 300 | 0.0152997 |
| 4 Olives | 36 | 15 | 540 | 0.004589924 | 75 | 0.0573741 |
| 3 Olives | 216 | 20 | 4,320 | 0.036719394 | 12 | 0.0734388 |
| 6 Umbrellas | 1 | 1 | 1 | 8.49986E−06 | 1500 | 0.002125 |
| 5 Umbrellas | 6 | 6 | 36 | 0.000305995 | 300 | 0.0152997 |
| 4 Umbrellas | 36 | 15 | 540 | 0.004589924 | 100 | 0.0764987 |
| 6 Oranges | 1 | 1 | 1 | 8.49986E−06 | 1000 | 0.0014166 |
| 5 Oranges | 6 | 6 | 36 | 0.000305995 | 200 | 0.0101998 |
| 4 Oranges | 36 | 15 | 540 | 0.004589924 | 50 | 0.0382494 |
| 3 Oranges | 216 | 20 | 4,320 | 0.036719394 | 9 | 0.0550791 |
| 6 Limes | 1 | 1 | 1 | 8.49986E−06 | 750 | 0.0010625 |
| 5 Limes | 6 | 6 | 36 | 0.000305995 | 100 | 0.0050999 |
| 4 Limes | 36 | 15 | 540 | 0.004589924 | 25 | 0.0191247 |
| 3 Limes | 216 | 20 | 4,320 | 0.036719394 | 9 | 0.0550791 |
| 6 Lemons | 1 | 1 | 1 | 8.49986E−06 | 750 | 0.0010625 |
| 5 Lemons | 6 | 6 | 36 | 0.000305995 | 100 | 0.0050999 |
| 4 Lemons | 36 | 15 | 540 | 0.004589924 | 25 | 0.0191247 |
| 3 Lemons | 216 | 20 | 4,320 | 0.036719394 | 9 | 0.0550791 |
| 2 Lemons | 1296 | 15 | 19,440 | 0.165237274 | 3 | 0.0826186 |
| 6 Cherries | 1 | 1 | 1 | 8.49986E−06 | 750 | 0.0010625 |
| 5 Cherries | 6 | 6 | 36 | 0.000305995 | 100 | 0.0050999 |
| 4 Cherries | 36 | 15 | 540 | 0.004589924 | 25 | 0.0191247 |
| 3 Cherries | 216 | 20 | 4,320 | 0.036719394 | 9 | 0.0550791 |
| 2 Cherries | 1296 | 15 | 19,440 | 0.165237274 | 3 | 0.0826186 |
| Expected Return | | | | | | 0.9030959 |

Moving to the second line of the paytable, the number of ways to get five Pineapples on the first five reels (without getting 6 Pineapples) is 1×1×1×1×1×6=6 and is shown in the second column of Table 3. This is because there is one Pineapple on each of the first five reels, while the sixth reel must "stop" on anything except a Pineapple, of which there are six other symbols. The number of ways to put five Pineapples on six reels, where P is a reel containing a Pineapple and X is a reel containing any other symbol is six, shown below in Table 4:

TABLE 4

| | |
|---|---|
| 1 | PPPPPX |
| 2 | PPPPXP |
| 3 | PPPXPP |
| 4 | PPXPPP |
| 5 | PXPPPP |
| 6 | XPPPPP |

The number of occurrences of five Pineapples is the product of column 2 and column 3, which is shown as 36 in the fourth column of Table 3.

Moving to the third line of the paytable, the number of ways to get four Pineapples on the first four reels (without getting five or six Pineapples) is 1×1×1×1×6×6=36, and is shown in the second column of Table 3. This is because there is one Pineapple on each of the first four reels, while the fifth and sixth reels must "stop" on anything except a Pineapple, of which there are six other symbols. The number of ways to put four Pineapples on six reels where P is a reel containing a pineapple and X is a reel containing any other symbol is 15, shown below in Table 5:

TABLE 5

| | |
|---|---|
| 1 | XXPPPP |
| 2 | XPXPPP |
| 3 | XPPXPP |
| 4 | XPPPXP |
| 5 | XPPPPX |
| 6 | PXXPPP |
| 7 | PXPXPP |
| 8 | PXPPXP |
| 9 | PXPPPX |

TABLE 5-continued

| | |
|---|---|
| 10 | PPXXPP |
| 11 | PPXPXP |
| 12 | PPXPPX |
| 13 | PPPXXP |
| 14 | PPPXPX |
| 15 | PPPPXX |

The number of occurrences of four Pineapples is the product of column two and column three, which is shown as 540 in the fourth column ("Occurrences") of Table 3.

The second, third and fourth columns are filled in for each additional line in Table 3 in the same manner.

The fifth column of Table 3 ("Probability") is computed by dividing the fourth column "Occurrences" by the total number of possible outcomes which is $7^6$=117,649.

The sixth column is the paytable value for the first column combination.

The seventh column is the expected value (EV) contribution of the payline, which is computed by multiplying the fifth and sixth columns and dividing this product by the six coins required to play the game (with six reels) selected. This is the contribution to the total expected rate of return measured as a fraction of one coin bet.

The sum of all values in the "EV" column (see bottom right) is the expected return when six reels are selected which is 0.9030959 or 90.30959%. When six reels are selected, the machine will return about 90% of the money that is wagered over the long run.

One way to modify the expected return of the game would be to modify the "Pay" numbers on the spreadsheet. Alternatively, changing the symbol frequencies on the reel strips will also result in a different expected return. Once the symbol frequencies are modified, the paytable "Pay" values will probably also need to be modified to raise or lower the expected return to the desired level, as is well known in the art.

Different items could also be added to or removed from the paytable. In this example, four or more Umbrellas, three or more Pineapples, Olives, Oranges or Limes, or two or more Cherries or Lemons, results in a winning hand. Items could be added or removed from the paytable to modify the return, and then most likely the paytable "Pay" values will also need to be modified to raise or lower the expected return to the desired level.

Changing the reel symbol frequencies, or adding or removing lines from the paytable, will also affect the "hit rate" of the game. The hit rate is the percentage of spins that result in any win (even if the amount paid is less than the amount that was wagered). Hit rate can be an important factor in the "feel" of a gaming machine to a player.

Due to the fact that certain combinations will pay multiple paytable lines, it is not possible to read the hit rate off of the spreadsheet that is used to set the pay values and determine the expected return. A computer program using the "C" programming language to analyze each of the possible 117,649 spins is, however, readily made and known in the art. For each possible spin the program determined if there are any "hits" on the paytable and records the number of spins containing one or more hits. For the six reel selected example here, the number of spins with any hit is 63,109 resulting in a hit rate of 63,109/117,649=53.6418%.

Eight Reels Selected

As indicated earlier, the entire construction of the game is different for each number of reels selected. The analysis for eight reels selected will now be shown. The eight reels selected model uses different reel frequencies than was used when six reels were selected. This modification may be made for a variety of reasons (for example, as one gets down to a lower number of reels selected, it is considered necessary to use reels with many more than the seven stop positions to create an attractive game). In the case of eight reels selected, the reels were increased to nine reel stop positions (or symbols per reel) to keep the frequency of getting to the bonus game (here, four or more Umbrellas) in the range of 90 to 250 spins.

As in the six reel selected model, all thirty-two reels use the same reel symbol frequencies. Table 6 shows the symbol frequencies for each of the thirty-two reels when eight reels are selected.

TABLE 6

| Reel Strip Frequencies | | |
|---|---|---|
| Symbol | Number of Occurrences | Probability |
| Pineapple | 1 | 0.111111 |
| Olive | 1 | 0.111111 |
| Umbrella | 1 | 0.111111 |
| Orange | 1 | 0.111111 |
| Lime | 1 | 0.111111 |
| Lemon | 2 | 0.222222 |
| Cherry | 2 | 0.222222 |
| Total Reel Stop Positions | 9 | 1.000000 |

Table 7 shows the expected return calculation using the same method described above regarding the construction of Table 3. While the method of calculating the values is identical to that shown above, the occurrence of two Cherries and two Lemons on each reel cause the results for Cherries and Lemons to be different than the other symbols.

TABLE 7

| Paying Combination | Occurrences With Symbols in First Reels | Ways to Make This | Occurrences | Probability | Pay | EV |
|---|---|---|---|---|---|---|
| 8 Pineapples | 1 | 1 | 1 | 2.32306E−08 | 20000 | 5.808E−05 |
| 7 Pineapples | 8 | 8 | 64 | 1.48676E−06 | 1500 | 0.0002788 |
| 6 Pineapples | 64 | 28 | 1,792 | 4.16292E−05 | 500 | 0.0026018 |
| 5 Pineapples | 512 | 56 | 28,672 | 0.000666067 | 100 | 0.0083258 |
| 4 Pineapples | 4,096 | 70 | 286,720 | 0.00666067 | 45 | 0.0374663 |
| 8 Olives | 1 | 1 | 1 | 2.32306E−08 | 20000 | 5.808E−05 |
| 7 Olives | 8 | 8 | 64 | 1.48676E−06 | 1500 | 0.0002788 |
| 6 Olives | 64 | 28 | 1,792 | 4.16292E−05 | 500 | 0.0026018 |
| 5 Olives | 512 | 56 | 28,672 | 0.000666067 | 100 | 0.0083258 |
| 4 Olives | 4,096 | 70 | 286,720 | 0.00666067 | 45 | 0.0374663 |
| 8 Umbrellas | 1 | 1 | 1 | 2.32306E−08 | 1000 | 2.904E−06 |

TABLE 7-continued

| Paying Combination | Occurrences With Symbols in First Reels | Ways to Make This | Occurrences | Probability | Pay | EV |
|---|---|---|---|---|---|---|
| 7 Umbrellas | 8 | 8 | 64 | 1.48676E−06 | 500 | 9.292E−05 |
| 6 Umbrellas | 64 | 28 | 1,792 | 4.16292E−05 | 250 | 0.0013009 |
| 5 Umbrellas | 512 | 56 | 28,672 | 0.000666067 | 150 | 0.0124888 |
| 4 Umbrellas | 4,096 | 70 | 286,720 | 0.00666067 | 100 | 0.0832584 |
| 8 Oranges | 1 | 1 | 1 | 2.32306E−08 | 10000 | 2.904E−05 |
| 7 Oranges | 8 | 8 | 64 | 1.48676E−06 | 800 | 0.0001487 |
| 6 Oranges | 64 | 28 | 1,792 | 4.16292E−05 | 300 | 0.0015611 |
| 5 Oranges | 512 | 56 | 28,672 | 0.000666067 | 125 | 0.0104073 |
| 4 Oranges | 4,096 | 70 | 286,720 | 0.00666067 | 30 | 0.0249775 |
| 8 Limes | 1 | 1 | 1 | 2.32306E−08 | 10000 | 2.904E−05 |
| 7 Limes | 8 | 8 | 64 | 1.48676E−06 | 300 | 5.575E−05 |
| 6 Limes | 64 | 28 | 1,792 | 4.16292E−05 | 100 | 0.0005204 |
| 5 Limes | 512 | 56 | 28,672 | 0.000666067 | 36 | 0.0029973 |
| 4 Limes | 4,096 | 70 | 286,720 | 0.00666067 | 18 | 0.0149865 |
| 8 Lemons | 256 | 1 | 256 | 5.94703E−06 | 10000 | 0.0074338 |
| 7 Lemons | 896 | 8 | 7,168 | 0.000166517 | 300 | 0.0062444 |
| 6 Lemons | 3,136 | 28 | 87,808 | 0.00203983 | 100 | 0.0254979 |
| 5 Lemons | 10,976 | 56 | 614,656 | 0.014278811 | 36 | 0.0642547 |
| 4 Lemons | 38,416 | 70 | 2,689,120 | 0.062469799 | 18 | 0.140557 |
| 3 Lemons | 134,456 | 56 | 7,529,536 | 0.174915437 | 4 | 0.0874577 |
| 8 Cherries | 256 | 1 | 256 | 5.94703E−06 | 10000 | 0.0074338 |
| 7 Cherries | 896 | 8 | 7,168 | 0.000166517 | 300 | 0.0062444 |
| 6 Cherries | 3,136 | 28 | 87,808 | 0.00203983 | 100 | 0.0254979 |
| 5 Cherries | 10,976 | 56 | 614,656 | 0.014278811 | 36 | 0.0642547 |
| 4 Cherries | 38,416 | 70 | 2,689,120 | 0.062469799 | 18 | 0.140557 |
| 3 Cherries | 134,456 | 56 | 7,529,536 | 0.174915437 | 4 | 0.0874577 |
| Expected Return | | | | | | 0.9132089 |

For eight Cherries, the number of occurrences of getting eight Cherries on the first eight reels is $2^8$=256. For seven Cherries the number of occurrences of getting seven Cherries on the first seven reels without getting eight Cherries is 2×2×2×2×2×2×2×7=896. For six Cherries the number of occurrences of getting six Cherries on the first six reels without getting seven or eight Cherries is 2×2×2×2×2×2×7×7=3136.

The rest of the analysis is identical to that used to discuss Table 3, resulting in an expected return of 0.9132089 or 91.32089%.

When eight reels are selected with nine reel stop positions per reel, there are $9^8$=43,046,721 possible reel combinations. The number of hits is 21,991,561, resulting in a hit rate of 51.0977%.

Ten Reels Selected

Table 8 shows the analysis for when ten reels are selected. When ten reels are selected, the reel strip frequencies used are the same as shown in Table 2 (seven symbols per reel).

TABLE 8

| Paying Combination | Occurrences With Symbols in First Reels | Ways to Make This | Occurrences | Probability | Pay | EV |
|---|---|---|---|---|---|---|
| 10 Pineapples | 1 | 1 | 1 | 3.54013E−09 | 100000 | 3.54E−05 |
| 9 Pineapples | 6 | 10 | 60 | 2.12408E−07 | 7500 | 0.0001593 |
| 8 Pineapples | 36 | 45 | 1,620 | 5.73502E−06 | 500 | 0.0002868 |
| 7 Pineapples | 216 | 120 | 25,920 | 9.17603E−05 | 250 | 0.002294 |
| 6 Pineapples | 1296 | 210 | 272,160 | 0.000963483 | 100 | 0.0096348 |
| 5 Pineapples | 7776 | 252 | 1,959,552 | 0.006937075 | 60 | 0.0416225 |
| 4 Pineapples | 46656 | 210 | 9,797,760 | 0.034685375 | 30 | 0.1040561 |
| 10 Olives | 1 | 1 | 1 | 3.54013E−09 | 100000 | 3.54E−05 |
| 9 Olives | 6 | 10 | 60 | 2.12408E−07 | 7500 | 0.0001593 |
| 8 Olives | 36 | 45 | 1,620 | 5.73502E−06 | 500 | 0.0002868 |
| 7 Olives | 216 | 120 | 25,920 | 9.17603E−05 | 250 | 0.002294 |
| 6 Olives | 1296 | 210 | 272,160 | 0.000963483 | 100 | 0.0096348 |
| 5 Olives | 7776 | 252 | 1,959,552 | 0.006937075 | 60 | 0.0416225 |
| 4 Olives | 46656 | 210 | 9,797,760 | 0.034685375 | 30 | 0.1040561 |
| 10 Umbrellas | 1 | 1 | 1 | 3.54013E−09 | 100000 | 3.54E−05 |
| 9 Umbrellas | 6 | 10 | 60 | 2.12408E−07 | 10000 | 0.0002124 |
| 8 Umbrellas | 36 | 45 | 1,620 | 5.73502E−06 | 1500 | 0.0008603 |
| 7 Umbrellas | 216 | 120 | 25,920 | 9.17603E−05 | 500 | 0.004588 |
| 6 Umbrellas | 1296 | 210 | 272,160 | 0.000963483 | 300 | 0.0289045 |
| 5 Umbrellas | 7776 | 252 | 1,959,552 | 0.006937075 | 150 | 0.1040561 |
| 10 Oranges | 1 | 1 | 1 | 3.54013E−09 | 75000 | 2.655E−05 |
| 9 Oranges | 6 | 10 | 60 | 2.12408E−07 | 6500 | 0.0001381 |
| 8 Oranges | 36 | 45 | 1,620 | 5.73502E−06 | 400 | 0.0002294 |
| 7 Oranges | 216 | 120 | 25,920 | 9.17603E−05 | 200 | 0.0018352 |

TABLE 8-continued

| Paying Combination | Occurrences With Symbols in First Reels | Ways to Make This | Occurrences | Probability | Pay | EV |
|---|---|---|---|---|---|---|
| 6 Oranges | 1296 | 210 | 272,160 | 0.000963483 | 75 | 0.0072261 |
| 5 Oranges | 7776 | 252 | 1,959,552 | 0.006937075 | 40 | 0.0277483 |
| 4 Oranges | 46656 | 210 | 9,797,760 | 0.034685375 | 15 | 0.0520281 |
| 10 Limes | 1 | 1 | 1 | 3.54013E−09 | 50000 | 1.77E−05 |
| 9 Limes | 6 | 10 | 60 | 2.12408E−07 | 5000 | 0.0001062 |
| 8 Limes | 36 | 45 | 1,620 | 5.73502E−06 | 300 | 0.0001721 |
| 7 Limes | 216 | 120 | 25,920 | 9.17603E−05 | 100 | 0.0009176 |
| 6 Limes | 1296 | 210 | 272,160 | 0.000963483 | 50 | 0.0048174 |
| 5 Limes | 7776 | 252 | 1,959,552 | 0.006937075 | 27 | 0.0187301 |
| 4 Limes | 46656 | 210 | 9,797,760 | 0.034685375 | 12 | 0.0416225 |
| 3 Limes | 279936 | 120 | 33,592,320 | 0.118921286 | 5 | 0.0594606 |
| 10 Lemons | 1 | 1 | 1 | 3.54013E−09 | 50000 | 1.77E−05 |
| 9 Lemons | 6 | 10 | 60 | 2.12408E−07 | 5000 | 0.0001062 |
| 8 Lemons | 36 | 45 | 1,620 | 5.73502E−06 | 300 | 0.0001721 |
| 7 Lemons | 216 | 120 | 25,920 | 9.17603E−05 | 100 | 0.0009176 |
| 6 Lemons | 1296 | 210 | 272,160 | 0.000963483 | 50 | 0.0048174 |
| 5 Lemons | 7776 | 252 | 1,959,552 | 0.006937075 | 27 | 0.0187301 |
| 4 Lemons | 46656 | 210 | 9,797,760 | 0.034685375 | 12 | 0.0416225 |
| 3 Lemons | 279936 | 120 | 33,592,320 | 0.118921286 | 5 | 0.0594606 |
| 10 Cherries | 1 | 1 | 1 | 3.54013E−09 | 50000 | 1.77E−05 |
| 9 Cherries | 6 | 10 | 60 | 2.12408E−07 | 5000 | 0.0001062 |
| 8 Cherries | 36 | 45 | 1,620 | 5.73502E−06 | 300 | 0.0001721 |
| 7 Cherries | 216 | 120 | 25,920 | 9.17603E−05 | 100 | 0.0009176 |
| 6 Cherries | 1296 | 210 | 272,160 | 0.000963483 | 50 | 0.0048174 |
| 5 Cherries | 7776 | 252 | 1,959,552 | 0.006937075 | 27 | 0.0187301 |
| 4 Cherries | 46656 | 210 | 9,797,760 | 0.034685375 | 12 | 0.0416225 |
| 3 Cherries | 279936 | 120 | 33,592,320 | 0.118921286 | 5 | 0.0594606 |
| Expected Return | | | | | | 0.9215986 |

When ten reels are selected with seven reel stop positions per reel, there are $7^{10}$=282,475,249 possible reel combinations. The number of hits is 157,113,649 resulting in a hit rate of 55.6203%.

It can be seen that as more reels are added, the probability of getting all of the reels to show the same symbol gets dramatically reduced. This allows for very large payouts to be available when enough reels are selected. Those skilled in the art will appreciate that the number of reels being selected could be easily increased beyond ten, however the odds of getting eleven out of eleven or higher become, shall we say, stratospheric. Even at ten reels with only seven symbols on each reel, the odds of a particular ten symbol combination are over 1 in 282 million, and the odds of getting any ten symbol combination are over 1 in 40 million.

While all of the other number of reels selected can be constructed in a similar manner, the construction for two reels selected and one reel selected are shown below, because the construction varies a bit at this other extreme.

Two Reels Selected

As in the other reel selections, all thirty-two reels use the same reel symbol frequencies. Table 9 shows the symbol frequencies for all thirty-two reels when two reels are selected.

TABLE 9

| Symbol | Number of Occurrences | Probability |
|---|---|---|
| Pineapple | 1 | 0.021277 |
| Olive | 1 | 0.021277 |
| Umbrella | 4 | 0.085106 |
| Orange | 10 | 0.212766 |
| Lime | 12 | 0.255319 |
| Lemon | 12 | 0.255319 |
| Cherry | 7 | 0.148936 |
| Total Reel Stop Positions | 47 | |

The analysis of this paytable with two reels selected is identical to the other number of reels. While when a higher number of reels is selected, the approach is to use a reel with a low number of stop positions and then use the determination of what combinations pay and the paytable values to balance out the game. In the case of two reels selected, we move to a reel with forty-seven symbols and adjust the frequency of the awards through the frequency of the different symbols on these reels. Table 10 shows the expected return of this model to be 0.8843368 or 88.43368%.

TABLE 10

| Paying Combination | Occurrences With Symbols in First Reels | Ways to Make This | Occurrences | Probability | Pay | EV |
|---|---|---|---|---|---|---|
| 2 Pineapples | 1 | 1 | 1 | 0.000452694 | 100 | 0.0226347 |
| 2 Olives | 1 | 1 | 1 | 0.000452694 | 100 | 0.0226347 |
| 2 Umbrellas | 16 | 1 | 16 | 0.007243096 | 35 | 0.1267542 |
| 2 Oranges | 100 | 1 | 100 | 0.045269353 | 10 | 0.2263468 |
| 2 Limes | 144 | 1 | 144 | 0.065187868 | 5 | 0.1629697 |
| 2 Lemons | 144 | 1 | 144 | 0.065187868 | 5 | 0.1629697 |

TABLE 10-continued

| Paying Combination | Occurrences With Symbols in First Reels | Ways to Make This | Occurrences | Probability | Pay | EV |
|---|---|---|---|---|---|---|
| 2 Cherries | 49 | 1 | 49 | 0.022181983 | 3 | 0.033273 |
| 1 Cherry | 280 | 2 | 560 | 0.253508375 | 1 | 0.1267542 |
| Expected Return | | | | | | 0.8843368 |

When two reels are selected with forty-seven reel stop positions per reel, there are $47^2=2209$ possible reel combinations. The number of hits is 1015 resulting in a hit rate of 45.9484%.

One Reel Selected

In this embodiment when one reel is selected, there is a designation of certain symbols as paying symbols and other symbols as non-paying symbols. In this embodiment, when one reel is selected the Pineapple, Olive, Umbrella and Cherry are the symbols that pay. The Umbrella still takes the player to a bonus round that occurs on an average of once every 128 spins.

As in the other models, all thirty-two reels use the same reel symbol frequencies. Table 11 shows the symbol frequencies for all thirty-two reels when one reel is selected.

TABLE 11

| Symbol | Number of Occurrences | Probability |
|---|---|---|
| Pineapple | 1 | 0.007813 |
| Olive | 1 | 0.007813 |
| Umbrella | 1 | 0.007813 |
| Orange | 25 | 0.195313 |
| Lime | 25 | 0.195313 |
| Lemon | 25 | 0.195313 |
| Cherry | 50 | 0.390625 |
| Total Reel Stop Positions | 128 | |

Table 12 provides a similar analysis for this one reel selected version showing the expected return is 0.8828125 or 88.28125%.

When one reel is selected with 128 reel stop positions per reel, there are 128 possible reel combinations. The number of hits is 53, resulting in a hit rate of 41.4063%.

TABLE 12

| Paying Combination | Occurrences With Symbols in First Reels | Ways to Make This | Occurrences | Probability | Pay | EV |
|---|---|---|---|---|---|---|
| 1 Pineapple | 1 | 1 | 1 | 0.0078125 | 20 | 0.15625 |
| 1 Olive | 1 | 1 | 1 | 0.0078125 | 20 | 0.15625 |
| 1 Umbrella | 1 | 1 | 1 | 0.0078125 | 23 | 0.1796875 |
| 1 Cherry | 50 | 1 | 50 | 0.390625 | 1 | 0.390625 |
| Expected Return | | | | | | 0.8828125 |

To summarize this particular embodiment, Table 13 below illustrates the number of spots or reels played and the corresponding number of stop positions per reel or stop elements. Reviewing the previous analysis in conjunction with Table 13, one skilled in the art may assign which combinations are to be winning combinations and their pay values to attain a desired EV or return of money played.

TABLE 13

| Number of Spots Selected | Number of Stop Elements |
|---|---|
| 1 | 128 |
| 2 | 47 |
| 3 | 34 |
| 4 | 16 |
| 5 | 9 |
| 6 | 7 |
| 7 | 7 |
| 8 | 9 |
| 9 | 7 |
| 10 | 7 |

Additional figures or tables can be constructed in the same fashion as above for any specified number of selected reels or spots for playing a game with any specified number of reels or spots.

Another Embodiment

Figure 9:
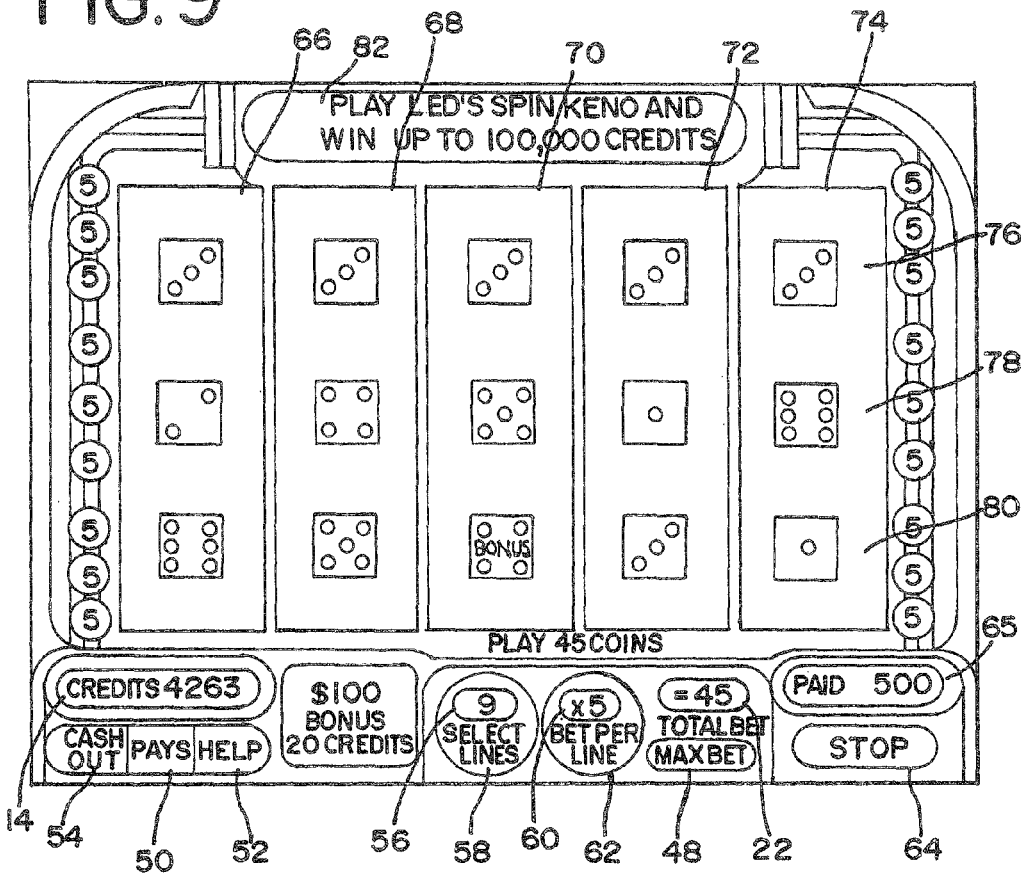
FIG. 9 is a screen from a video display showing another embodiment of the invention.

FIG. 9 reveals the display of a traditional spinning reel or video slot machine that employs another embodiment of the invention. Here, the game utilizes five reels 66, 68, 70, 72 and 74 on a video slot machine revealing three reel stop positions 76, 78, and 80 of each reel. The fifteen reel stop positions that are revealed make up the game element locations. The invention however is not limited to reels, either virtual or actual, and may employ any number or configuration of game element locations.

In this embodiment, the player selects how many and which of the game element locations that will be used to determine any winning combinations, i.e. one to fifteen game element locations. As in the previous embodiment, there would be a different paytable for each quantity of symbols selected. As contrasted with popular video slot machines, this game allows a player to essentially construct his or her own "payline(s)", without confining the player to the traditional paylines used, nor confining the player to the fixed three or five symbols per payline that is common in video slot machines. However, a player can select game element locations that do resemble traditional paylines. One play that a player might choose is any five locations (symbols), either in a contiguous or discontinuous geometry for one of the player's "payline." Another play that might be chosen is all three locations on one reel. The payout is, as before, based upon the aggregate number of matching symbols that result in the gameplay.

FIG. 9 reveals one possible layout of a machine used to play this embodiment. The display includes a "Credits" meter 14, a "Cash Out" button 54, a "Pays" button 50, a "Help" button 52, a "Select Lines" meter 56, a "Select Lines" button 58, a "Bet Per Line" meter 60, a "Bet Per Line" button 62, a "Total Bet" meter 22, a "Max Bet" button 48, a "Spin/Stop" button 64, a "Paid" meter 65, and an information message 82. Other forms of the game elements can include, but not limited to, cards, icons, chips, flora, fauna, or any other form to attract players.

FIG. 9 also reveals one possible outcome of play wherein the player constructed and selected nine different "lines" and a wager of five coins on each line. One of the "lines" here does resemble a traditional payline that consisted of the top reel stop position 76 of each of the five reels 66, 68, 70, 72, and 74. Here, the player has won 500 credits for the picking and playing five locations that resulted in each location having a die with three dots or pips. As stated above however, the winnings are not based upon traditional paylines but upon the aggregate number of matching symbols selected by the player. Therefore, the invention can accommodate play by players that are stuck in the traditional payline mentality.

Figure 10A:
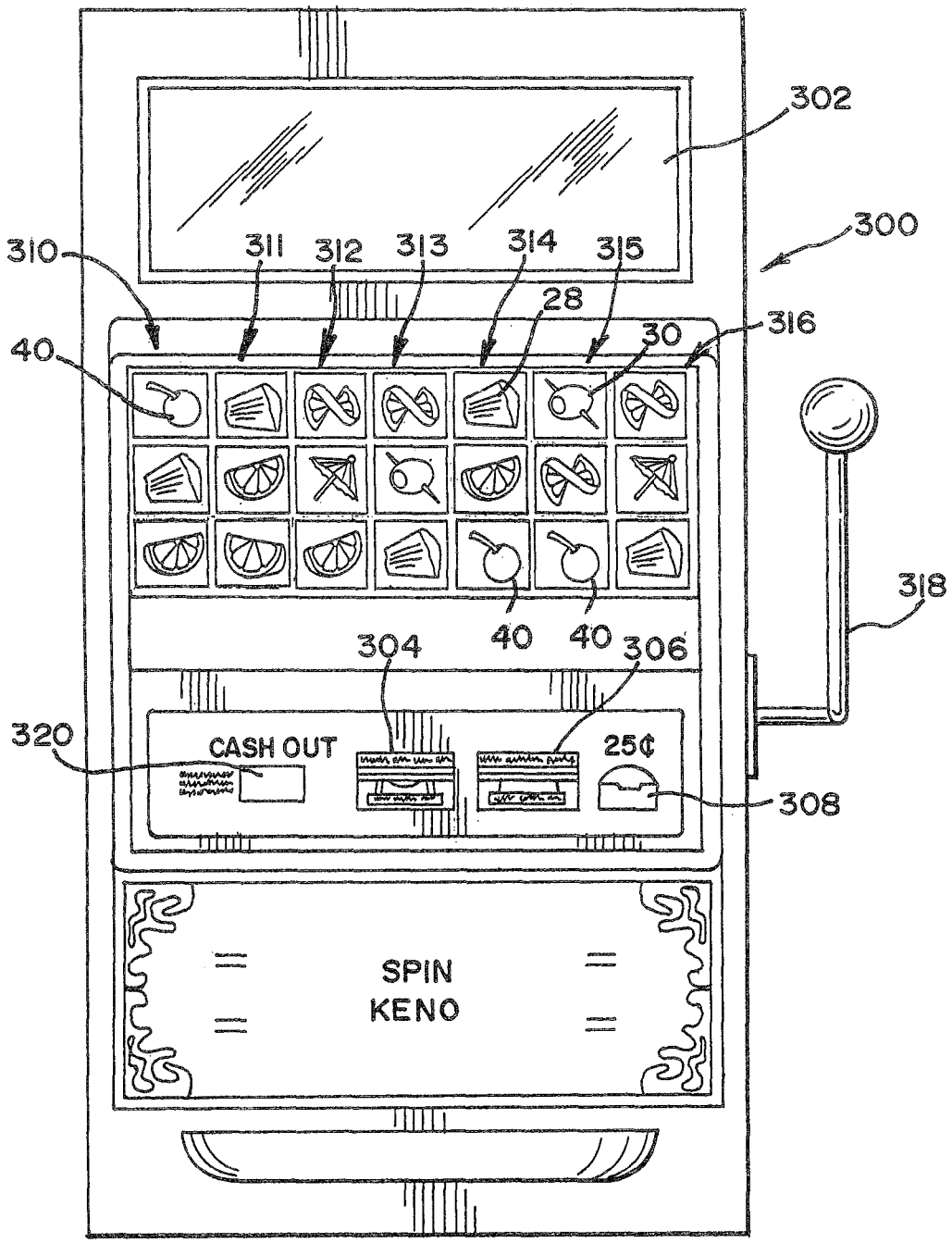
FIGS. 10*a* and 10*b* is another embodiment of the invention (in two variations) in the form of a mechanical slot machine.

Two interesting further forms of the invention are shown in the embodiment of FIG. 10*a*. This will be recognized as a standard-type mechanical slot machine, the details of which will be largely not set forth herein, the same being extremely well known. That said, the machine 300 has a video or other display 302 for game attractions, scoring, paytables, help-screens, instructions and the like. For input and then registration of a wager, there is a bill acceptor 304, card reader 306 and coin deposit 308. The reels could be mechanical reels (as in this embodiment of FIG. 10*a*), with a single reel occupying what has been designated as column 310. All of the different symbols are then reproduced on each strip (reel). Here, there are seven reels 310 through 316 (going by the vertical columns as each reel).

The player could select which, or the number of, reels to be played. Then the reels are spun by pulling the actuating arm 318. The operating mechanism of the machine then detects the matches of symbols for the selected reels in a well known manner. Here, for instance, there are three Cherries that would represent a winning condition if reels (columns) 310, 314 and 315 had been selected. The player could then cash out his or her winnings via the discharge hopper 320, or play again.

A variation of this embodiment allows the player to select individual positions from the twenty-one positions available (rather than selecting reels). Another variation provides twenty-one small reels for the twenty-one symbol positions in FIG. 10*a*.

Figure 10B:
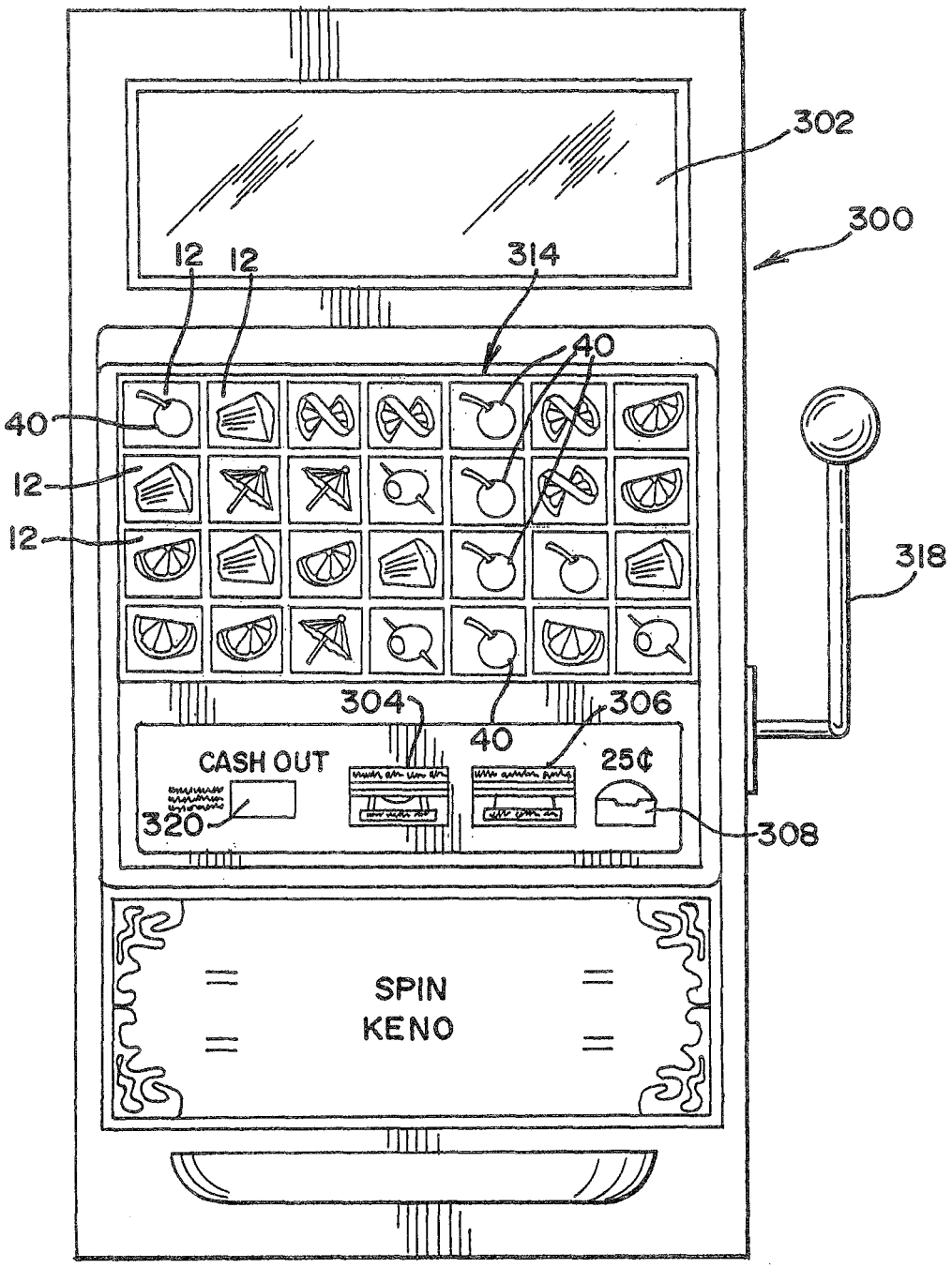

FIG. 10*b* shows a variation on the foregoing mechanical-type machine, where the mechanical reels have now been replaced by the video-type reels discussed above in relation to the first embodiment (FIGS. 1 through 8). Thus, the reels in FIG. 10*b* are now each of the symbol (game element) locations in this four by seven matrix. Selection of what reels to play and the registration of the same by the game is as previously described with respect to the embodiment of FIGS. 1 through 8. The arm 318 then becomes essentially a "button" to operate the gameplay.

A potentially interesting addition to the FIG. 10*b* embodiment is the use of a more traditional slot-machine type game to be played in conjunction with the aggregation-of-symbols game hitherto described. This would be a further award for certain spatial arrangements of symbols, such as the same (or otherwise matching) symbols showing up in vertical, diagonal or horizontal lines. This could be completely independent of spots picked. A payout for such arrangements would be in addition to the aggregate-symbol payout already discussed, perhaps for a special wager or an entirely additional wagering scheme. It could also be included for the base wager without departing from the invention. In FIG. 10*b*, for instance, a payout could be earned for the four Cherries 40 appearing in the vertical column 314, even if none of these four reels had been selected.

In yet another form of the invention, the player may select the symbols of the game. A player may want the symbols to be fruit-based, card-based, car-based, etc. This gives a player the illusion of further control by allowing the player to select target symbols that the player thinks or believes are lucky.

Figure 11:
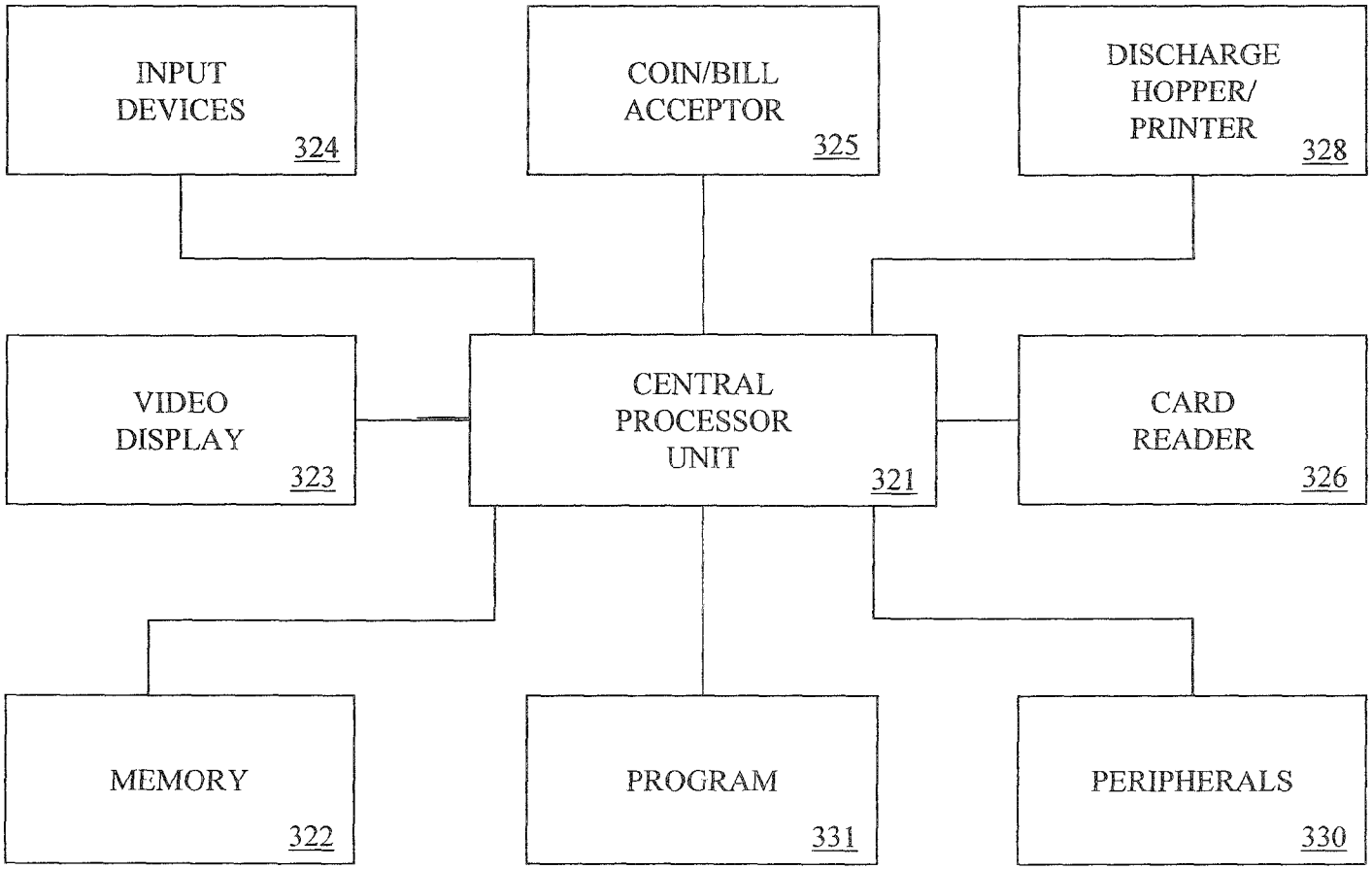
FIG. 11 is a schematic illustration of the major elements of an electronic gaming machine.

One form of the above-described embodiments is a single player program to be used or operated on an independent computerized gambling machine with a display. Insofar as the major components of the operating system for the game, these are schematically shown in FIG. 11. A processor(s) (CPU) 321 of standard conventional type is in communication with a number of different devices, including a memory 322 for data and other storage. The processor 321 runs (drives) the video display 323. Input devices, such as for making a wager, making player selections (e.g., touchscreen), and the like, are indicated collectively at 324. The wagering currency itself, or deposit, could be registered through a coin/bill acceptor 325, as well as a credit/debit card reader 326, which could also be a player tracking card. Winnings, or simply cashing out, would be effected through a hopper, printer or the like indicated at 328. Peripherals, such as music, lights, etc. operated by the CPU are collectively referred to at 330.

A program 331, of course, controls the play of the game. That would include the game rules and game elements, as well as some or all operating devices and drivers, and/or interfaces to communicate with the same.

The game programming is operationally summarized in the flowcharts of FIGS. 12 through 18. FIG. 12 generally describes a main loop 100 of the program.

The first element of the main loop 100 is an assessment of whether a coin, a dollar bill, a credit card was inserted into the Keno game by a player at step 102. If a coin, a bill, or a credit card was inserted into the Keno game, then the coin, bill, or credit card is processed at step 104 and the appropriate credits are registered and displayed on a "Credits" meter. Once credits are processed, the program returns to the main loop 100. If no coin, bill, or credit card is inserted then the program proceeds to step 106 and determines if there are any credits on the "Credits" meter. If the "Credits" meter has no credits, the program returns to complete step 102. If there are credits on the "Credits" meter, the program proceeds to enable or activate a plurality of player selection buttons at step 108. The Player Selection buttons include a "Coins Per Spot" button, a "Bet/Spin" button, a "Max Bet" button, a "Help" button, a "Pays" button, a "Clear Spots" button, and a "Quick Pick" button.

The program then determines if the player has selected a spot or reel (i.e., game element location) in step 110. If a spot was selected, the program executes a "select spot" subroutine, described hereafter, in step 112. The program will return to the main loop 100 when the select spot subroutine has been completed.

If a spot or reel has not been selected, then the program completes step 114 to determine if the player has actuated any of the player selection buttons. If none of the player selection buttons has been actuated, then the program returns to the main loop 100. The game cycles through the main loop 100 until the player actuates one of a plurality of player selection buttons, selects a spot, or adds more credits.

The player may choose to actuate a "Coins Per Spot" button. If the "Coins Per Spot" button is actuated, the program proceeds to increment the "Coins Per Spot" meter by 1 in step 116. In step 118, the program then determines if the "Coins Per Spot" value is greater than 9. If the "Coins Per Spot" value is not greater than 9, then the program returns to complete step 102 in the main loop 100. If the "Coins Per Spot" value is greater than 9, the program sets the "Coins Per Spot" value to 1 in step 120. Once the "Coins Per Spot" value is set to 1 and Coins Per Spot" meter is updated, the program returns to complete step 102 in the main loop 100.

The player may choose to actuate a "Bet/Spin" button. If the "Bet/Spin" button is actuated, the program determines if the bet amount is greater than zero in step 122. If the bet amount is not greater than zero, the program returns to complete step 102 in the main loop 100. If the bet amount is greater than zero, the program determines if the bet amount is greater than the credits meter value in step 124. If the bet amount is greater than the credits meter value, the program returns to complete step 102 in the main loop 100. If the bet amount is not greater than the credits meter value, the program proceeds to step 126 where the bet is calculated by multiplying the "Coins Per Spot" value by the value of a "Spots Played" variable. The "Credits" meter is then updated by subtracting the value of the bet in step 128. The program then calls a "spin reels" subroutine, described hereafter, at step 130. When program has returned from the "spin reels" subroutine, the program proceeds back to the main loop 100 to complete step 102.

Referring back to step 114, the player may have actuated the "Max Bet" button. If the "Max Bet" button is actuated, the program sets the "Coins Per Spot" value to nine in step 132. The program then returns to the main loop 100 to complete step 102.

Referring back to step 114, the player could have actuated the "Help" button. If the "Help" button is actuated, the program calls a "help screen" subroutine, described hereafter, to assist the player in step 134. After returning from the "help screen" subroutine, the program returns to the main loop 100 to complete step 102.

Again referring back to step 114, the player could have actuated the "Pays" button. If the "Pays" button is actuated, the program calls a "pays screen" subroutine, described hereafter, to display the paytables for the game in step 136. After returning from the "pays screen" subroutine, the program returns to the main loop 100 to complete step 102.

Yet again referring back to step 114, the player could have actuated the "Clear Spots" button. If the "Clear Spots" button is actuated, the program calls a "clears spots" subroutine, described hereafter, to de-select any spots chosen in step 138. After returning from the "clears spots" subroutine, the program returns to the main loop 100 to complete step 102.

Finally, the player could have actuated the "Quick Pick" button in reference to step 114. If the "Quick Pick" button is actuated, the program calls a "quick pick" subroutine, described hereafter, to randomly choose spots in step 140. After returning from the "quick pick" subroutine, the program returns to the main loop 100 to complete step 102.

Figure 13:
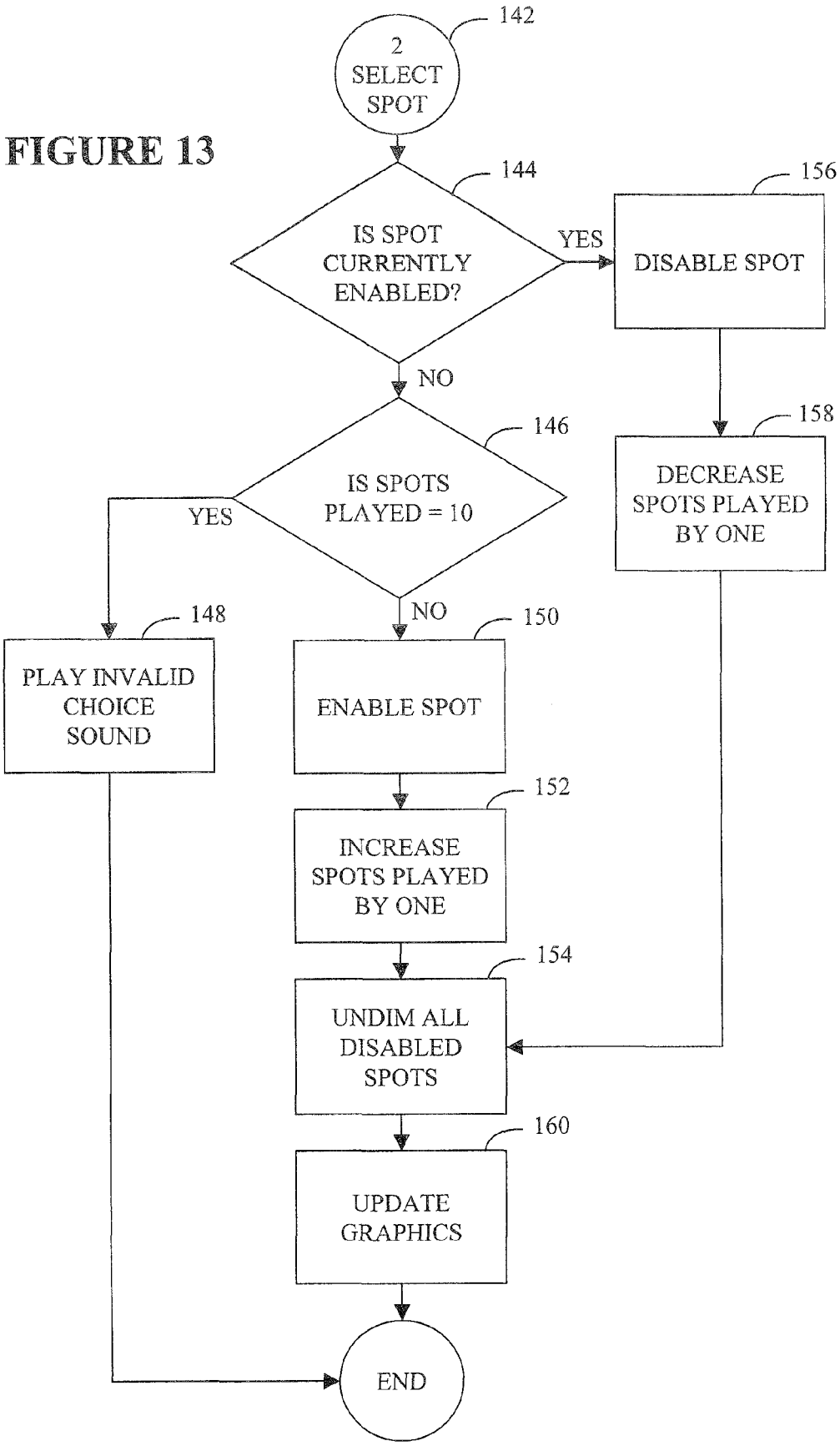

FIG. 13 depicts the "select spot" subroutine at step 112 of FIG. 12. The "select spot" subroutine begins at step 142 from the main loop 100 of the game. At step 144, a determination as to whether the spot chosen by the player is currently enabled. If the chosen spot is not enabled, the program proceeds to step 146 and determines if the spots played variable by the player is equal to ten. If the number of spots is equal to ten, the program plays an invalid choice sound sequence in step 148 and then returns to the main loop 100 (e.g. FIG. 20) to complete step 102.

Referring back to step 146, if the value of the spots played variable is not equal to 10, the program enables the chosen spot in step 150. In step 152, the program increases the value of the slots played variable by one. All disabled spots are un-dimmed or illuminated in step 154. Finally, the program updates the graphics on the gaming machine in step 160 and then returns to the main loop 100 (e.g. FIG. 12) to complete step 102.

Referring back to step 144, if the program determined that the chosen spot is enabled, the program disables the spot in step 156. In step 158, the value of the spots played variable is decreased by one. After completing step 158, the program proceeds to complete step 154 and continues on from there.

Figure 14:
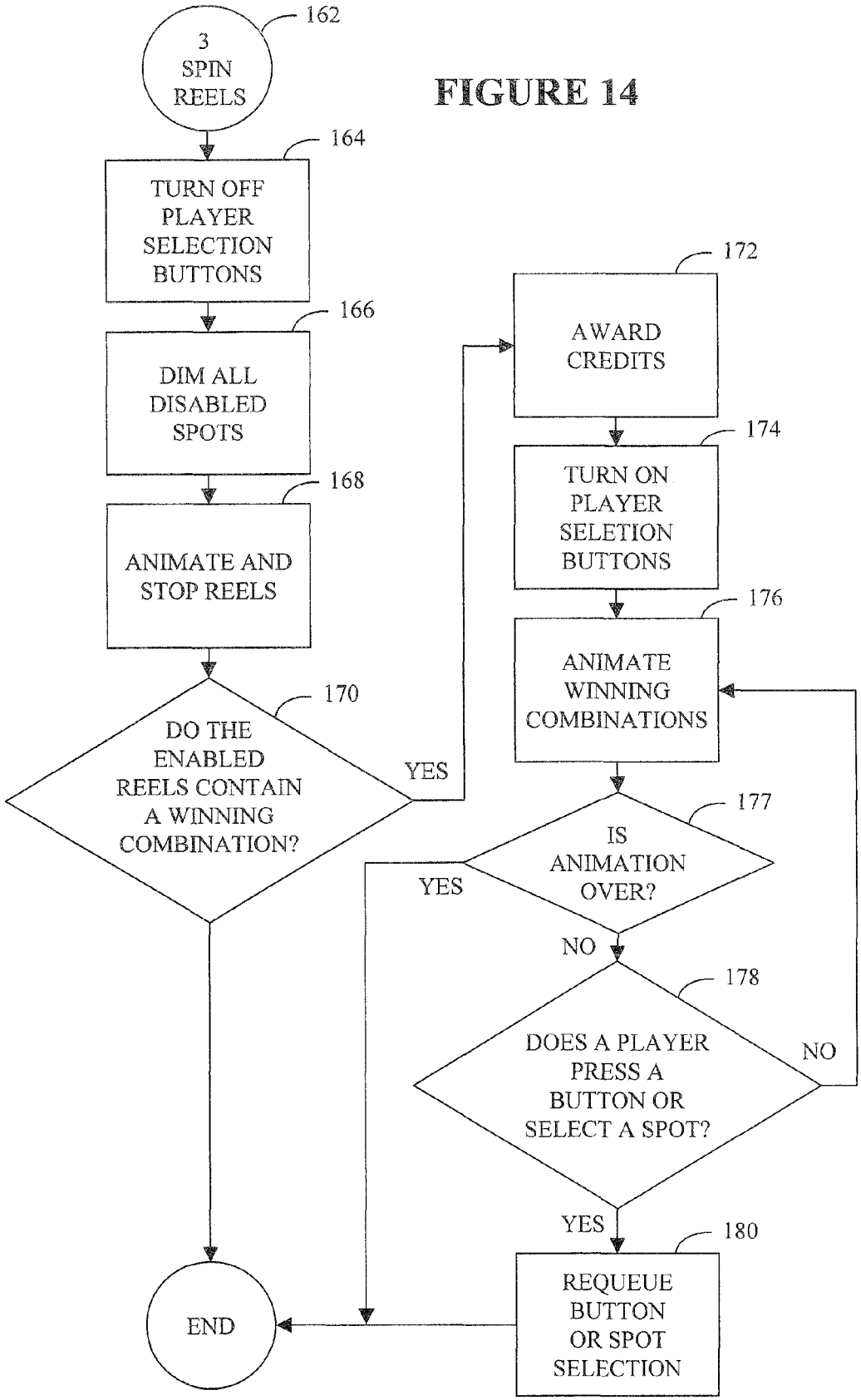

FIG. 14 depicts the "spin reels" subroutine of step 130 of FIG. 12. The "spin reels" subroutine begins at step 162 from the main loop 100 of the program. In step 164 all of the player selection buttons are turned off or disabled. Next, all of the disabled spots are dimmed in step 166. In step 168, the reel images are animated in a revolving fashion and "stopped" at the random number generated for that spot. The program determines in step 170 if any of the enabled reels or spots contain a winning combination. If there is no winning combination, the program returns to the main loop 100 (e.g. FIG. 12) to complete step 102.

If there is a winning combination of the enabled reels or spots, the program awards the corresponding credits of the winning combination in step 172. All of the player selection buttons are turned on or enabled in step 174. In step 176 the winning combination of reels is animated in a pleasing manner.

Next in step 177, the program determines if the animation of the winning combination has ended. If the animation has ended, the program will return to the main loop (e.g. FIG. 12) to complete step 102. If the animation has not ended, the program will proceed to step 178. In step 178, the program determines if the player has actuated a spot or a player selection button to "stop" the animated winning combination of reels. If the player has not actuated a spot or a player selection button, then the program loops back to step 176 to continue the animation. If the player has actuated a spot or a player selection button, the program requeues the button or spot for the main loop to process in step 180. The program then returns to the main loop 100 (e.g. FIG. 12) to complete step 102.

Figure 15:
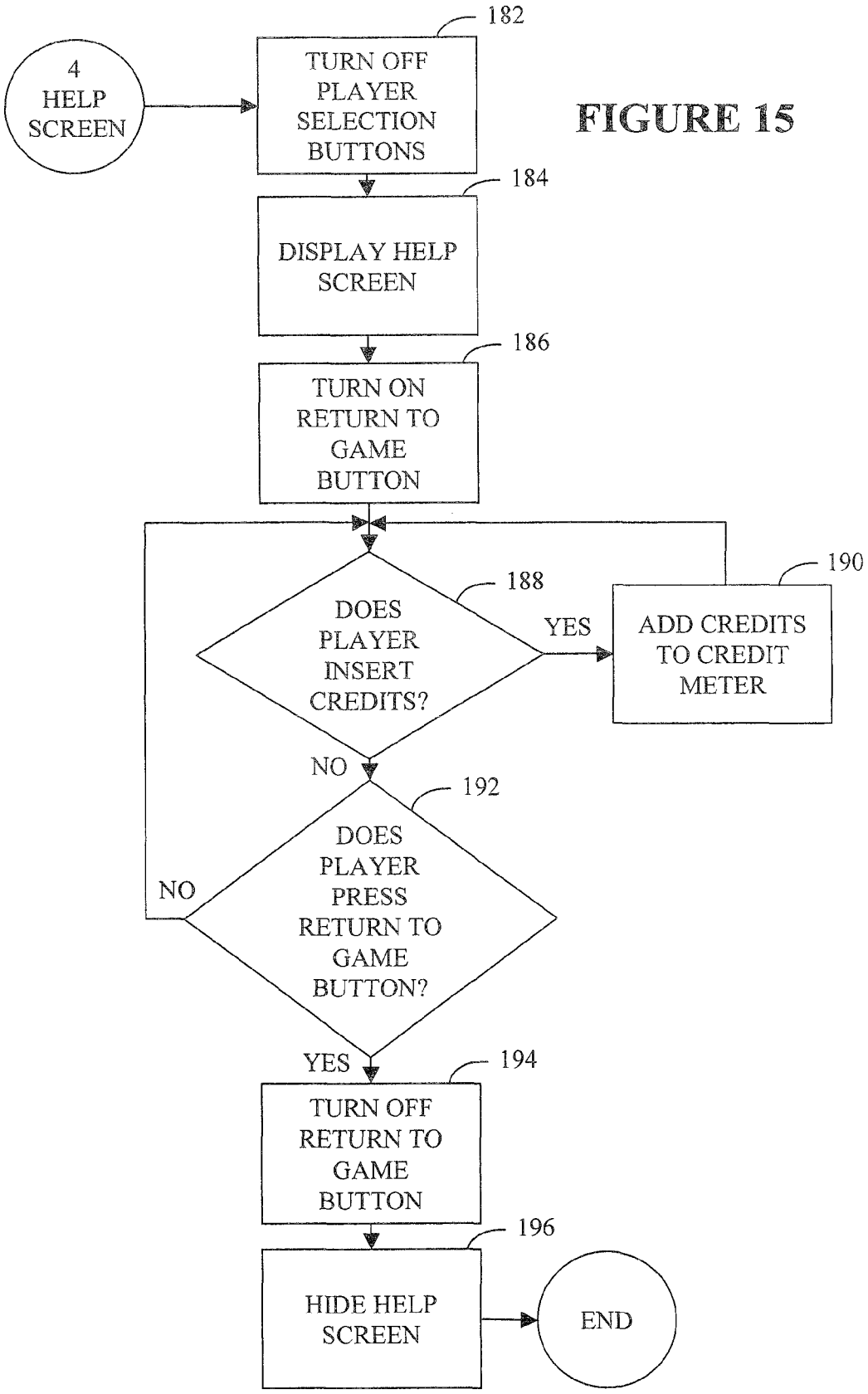

FIG. 15 depicts the "help" subroutine initiated at step 134 of FIG. 12. When the "help" subroutine is initiated, the program turns off or disables the player selection buttons in step 182. A help screen is displayed on the monitor of the gaming machine in step 184 and a "Return To Game" button in enabled in step 186.

Next, an assessment is made of whether a coin, a dollar bill, a credit card was inserted into the gaming machine at step 188. If a coin, a bill, or a credit card was inserted into the gaming machine, then the coin, bill, or credit card is processed at step 190 and the appropriate credits are registered and displayed on a "Credits" meter. Once credits are processed, the program returns to complete step 188 again. If no coin, bill, or credit card is inserted then the program proceeds to step 192 and determines if the player has actuated the "Return To Game" button. If the player has not actuated the "Return To Game" button, the program returns to the complete step 188 again. If the player has actuated the "Return To Game" button, the program disables or turns off the "Return to Game" button in step 194. Then in step 196, the program resumes the sSpin Keno game and fades out the help screen. Once step 196 is completed, the program returns to the main loop 100 (e.g. FIG. 12) to read the coin, bill, and credit card switches at step 102.

Figure 16:
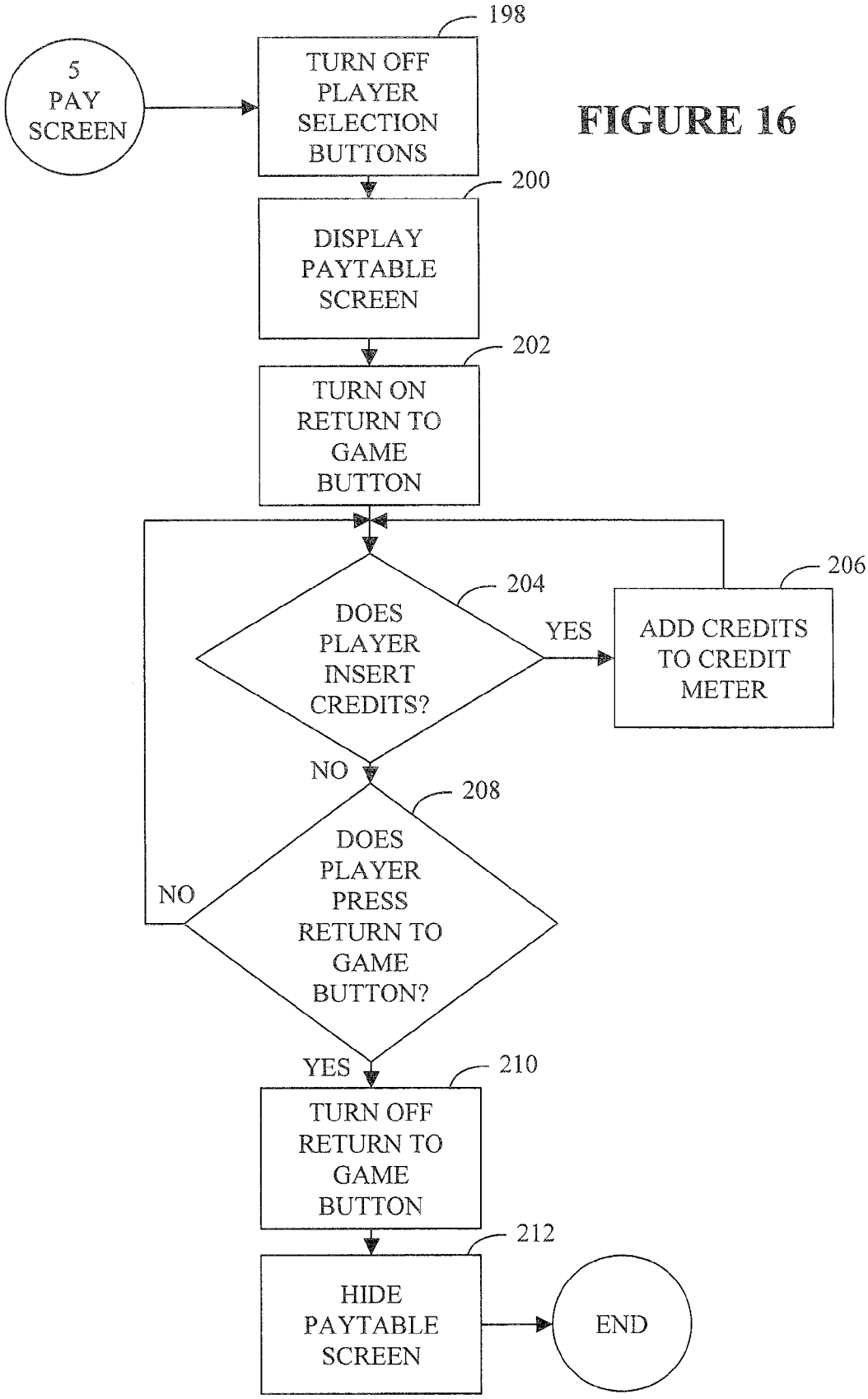

FIG. 16 depicts the "pay screen" subroutine initiated at step 136 of FIG. 12. When the "pay screen" subroutine is initiated, the program turns off or disables the player selection buttons in step 198. A paytable screen is displayed on the monitor of the gaming machine in step 200 and the "Return To Game" button in enabled in step 202.

A determination is made in step 204 of whether a coin, a dollar bill, a credit card was inserted into the gaming machine. If a coin, a bill, or a credit card was inserted into the gaming machine, then the coin, bill, or credit card is processed at step 206 and the appropriate credits are registered and displayed on a "Credits" meter. Once credits are processed, the program returns to complete step 204 again. If no coin, bill, or credit card is inserted then the program proceeds to step 208 and determines if the player has actuated the "Return To Game" button. If the player has not actuated the "Return To Game" button, the program returns to the complete step 204 again. If the player has actuated the "Return To Game" button, the program disables the "Return To Game" button in step 210. The program then obscures the Paytable Screen in step 212. Once step 212 is completed, the program returns to the main loop 100 (e.g. FIG. 12) to complete step 102.

Figure 17:
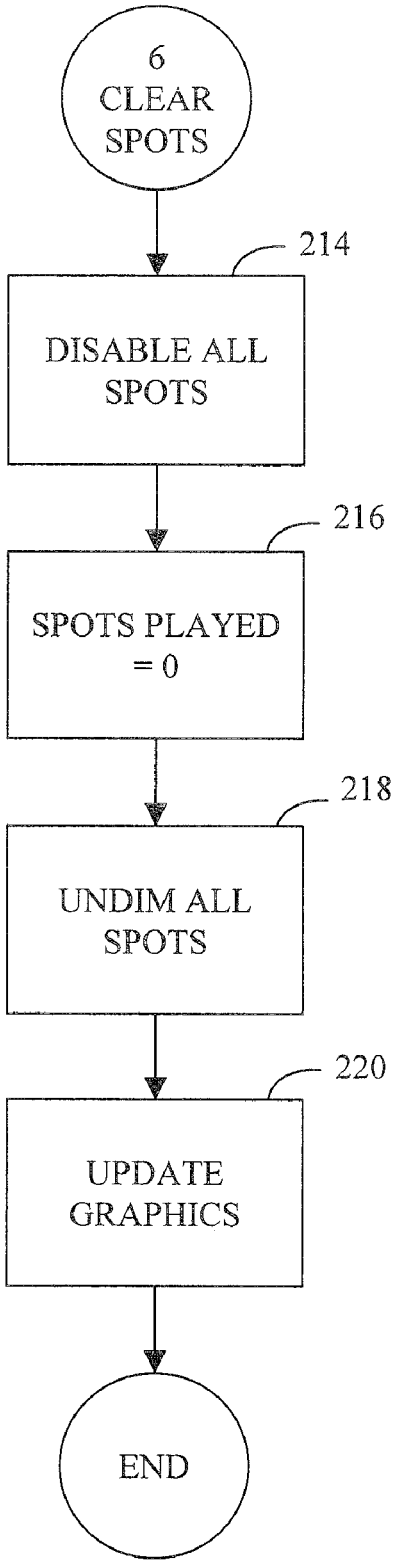

FIG. 17 depicts the "clear spots" subroutine as discussed in step 138 of FIG. 12. When the "clear spots" subroutine is initiated, the program turns off or disables all spots in step 214. The spots played variable is set to zero in step 216. All spots are un-dimmed or illuminated in step 218. Finally in step 220, the graphics on the gaming machine is updated as needed to start the spot selection process over. After these steps are completed, the program returns to the main loop 100 (e.g. FIG. 12) to complete step 102.

Figure 18:
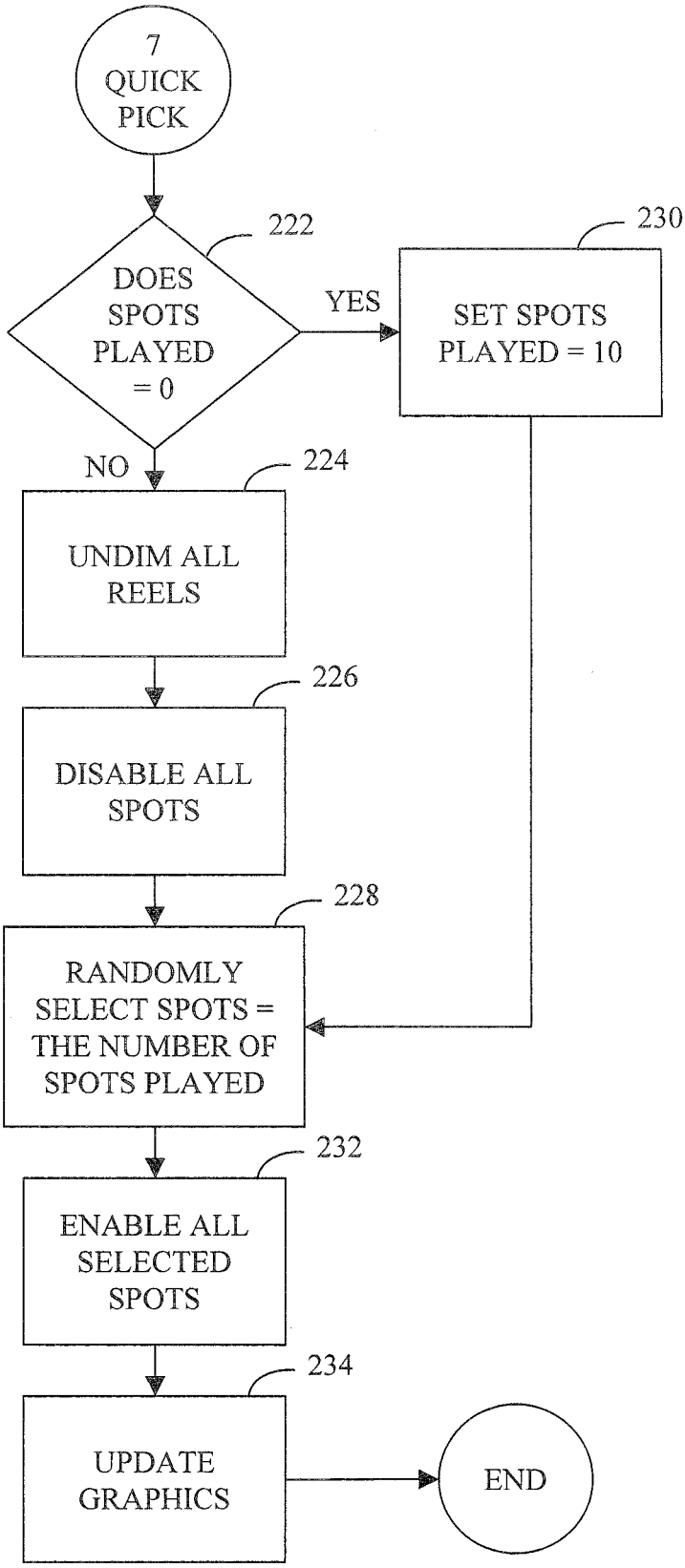

FIG. 18 depicts the "quick pick" subroutine as discussed in step 140 of FIG. 12. When the "quick pick" subroutine is initiated, the program determines if the spots played variable is equal to 0 in step 222. If the spots played variable is not equal to zero, the program undims all reels in step 224. In step 226, all spots are disabled. In step 228, the program randomly selects the number of spots that is equal to the value of the spots played variable.

Referring back to step 222, if the spots played variable is equal to zero, the program sets the value of the spots played variable to 10 in step 230. After step 230, the program completes step 228, discussed above.

After step 228 is complete, all of the randomly selected spots are enabled in step 232. Finally, the graphics on the gaming machine are updated in step 234. After these steps are completed, the program returns to the main loop 100 (e.g. FIG. 12) to complete step 102.

Thus, while the invention has been disclosed and described with respect to certain embodiments, those of skill in the art will recognize modifications, changes, other applications and the like which will nonetheless fall within the spirit and ambit of the invention, and the following claims are intended to capture such variations.

We claim:

1. A game playing apparatus for a game of chance, comprising:

a game display;

an operating system for said game apparatus including a processor, said processor having a program effecting play of said game of chance, said program having at least one payout table and a random number generating subroutine, said operating system further including a memory;

an input device through which a player provides a control input to said game apparatus;

a wagering input device; and a payout device;

said operating system: driving said display to present a plurality of game element locations; registering a selection input by a player of game element locations, where said program limits said selection to less than all of said plurality of game element locations; registering a wager input by the player upon an outcome of said game of chance; determining a game element indicium from a set of gameplay indicia to be displayed in at least said selected game element locations for a gameplay condition, said game element indicium to be displayed in each instance being randomly assigned for each said game element location from the entirety of said set of game element indicia displaying said randomly determined indicium for each said selected game element location; determining an outcome of said game of chance based upon said gameplay condition; and providing a payout, if any, according to a winning condition being determined as established by said payout table.

2. The apparatus of claim 1 wherein said gaming machine is a slot game, and said plurality of game element locations are represented as reels having a plurality of stop positions with said set of game element indicia being represented on each said reel.

3. The apparatus of claim 1 wherein said paytable has an award of increasing value for said winning condition based upon an aggregate number of matching indicia in the gameplay condition.

4. The apparatus of claim 3 wherein said paytable further includes a hierarchy of values based upon the type of indicium, such that certain indicium yield a greater award for the same aggregate number of matches.

5. A Keno-type gaming machine, comprising:

a game display having a plurality of game element locations;

an operating system for said game apparatus including a processor, said processor having a program effecting play of said game of chance, said program having at least one payout table and a random number generating subroutine for selecting game elements from a set of game elements with differing indicia;

a memory;

an input mechanism through which a player provides a control input to said game apparatus and a wagering input; and a payout device;

said operating system: driving said display to present a plurality of game element locations; registering a selection input by a player of game element locations, where said program limits said selection to less than all of said plurality of game element locations; registering a wager input by the player upon an outcome of said game of chance; after registering said selection and said wager, then determining a game element indicium from a set of gameplay indicia to be displayed in at least said selected game element locations for a gameplay condition, said game element indicium to be displayed in each instance being randomly assigned for each said game element location from the entirety of said set of game element indicia displaying said randomly determined indicium for each said selected game element location; determining an outcome of said game of chance based upon said gameplay condition; and providing a payout, if any, according to a winning condition being determined as established by said payout table.

6. The gaming machine of claim 5 wherein said random assignment of game elements is drawn from all of said game elements of said set for each said selected game element location.

7. The gaming machine of claim 5 wherein said paytable includes a predetermined minimum number of matching game element indicia for a winning condition.

8. The gaming machine of claim 5 wherein said set of game elements includes subsets of matching game elements, and wherein said random assignment of game elements involves only said set as a whole for a given gameplay.

9. The gaming machine of claim 6 wherein said game display is a matrix of rows and columns defining said game element locations.

10. The gaming machine of claim 9 wherein said random assignment of game elements is provided in the form of a spinning reel presentation for at least each said selected game element location, each said reel revealing a randomly assigned game element for a respective game element location in a reel-stop position.

11. The gaming machine of claim 8 wherein said paytable includes awards of increasing value for said winning condition based upon the aggregate number of matching indicia in the gameplay condition.

12. The gaming machine of claim 11 wherein said paytable further includes a hierarchy of values based upon the type of indicium, such that certain indicium yield a greater award for the same aggregate number of matches.

13. The gaming machine of claim 9 wherein said random assignment of game elements occurs for all said game element locations for a gameplay condition, and said winning condition further includes predetermined spatial arrangements of indicia in said matrix.

14. The gaming machine of claim 13 wherein said spatial arrangements include horizontal, vertical and diagonal lines.

15. A video gaming machine for playing a wagering game of chance, comprising:

a video game display for presentation of a plurality of game element locations;

an operating system for said game machine including a processor, said processor having a program effecting play of said game of chance, said program having at least one payout table and a random number generating subroutine for selecting game elements from a set of game elements with differing indicia; said operating system further including a memory;

an input mechanism through which a player provides a control input to said game apparatus and a wagering input; and a payout device;

said operating system: driving said display to present a plurality of game element locations; registering a selection input by a player of game element locations, where said program limits said selection to less than all of said plurality of game element locations; registering a wager input by the player upon an outcome of said game of chance; after registering said selection and said wager, then determining a game element indicium from a set of gameplay indicia to be displayed in at least said selected game element locations for a gameplay condition, said game element indicium to be displayed in each instance being randomly assigned for each said game element location from the entirety of said set of game element indicia displaying said randomly determined indicium for each said selected game element location; determining an outcome of said game of chance based upon said gameplay condition; and providing a payout, if any, according to a winning outcome being determined as established by said payout table.

16. The gaming machine of claim 15 wherein said paytable includes a predetermined minimum number of matching game element indicia for a winning outcome.

17. The gaming machine of claim 16 wherein said paytable includes an award that increases in value for said winning outcome based upon an increase in the aggregate number of matching indicia in the gameplay condition.

18. The gaming machine of claim 17 wherein said paytable further includes a hierarchy of values based upon the type of indicium, such that certain indicium yield a greater award for the same aggregate number of matches.

19. The gaming machine of claim 18 wherein said random assignment of game elements is provided in the form of a spinning reel presentation for at least each said selected game element location, each said reel revealing a randomly assigned game element for a respective game element location in a reel-stop position, and all of said game elements of said set are available on each said reel.

20. The gaming machine of claim 18 wherein said operating system includes a plurality of paytables, said paytables being of increasing values one paytable to the next, a respective paytable being applied to determine an outcome of the game according to the aggregate number of game element locations selected.

21. The gaming machine of claim 20 wherein said wager is based upon the aggregate number of game element locations selected and a wagered amount per location.

22. The gaming machine of claim 19 wherein said wager is based upon the aggregate number of reels selected and a wagered amount per reel.

23. A slot-type gaming machine using a spinning reel visual presentation, said reels being either mechanical or video, comprising:

a plurality of reels in a display, each of said reels having a plurality of game indicia with at least some of said indicia being different from each other;

an operating system for said machine;

an input mechanism through which a player provides a control input to said game apparatus and a wagering input; and a payout device;

said operating system: registering a selection input by a player of selected reels, where said selection is limited to less than all of said reels; registering a wager input by the player upon an outcome of said game; and after registering said selection and said wager, then spinning at least said selected reels for a gameplay condition, said game element indicium to be displayed in each instance being randomly arrived at from a set of gameplay indicia for each said reel;

an outcome of said game of chance being determined based upon said gameplay condition, with a payout, if any, according to a winning outcome being determined as established by a payout table.

24. The gaming machine of claim 23 wherein said outcome is predicated upon a predetermined associative methodology including matches of indicia, with a payout of an increasing value depending on the aggregate number of matching indicia of said selected reels in said gameplay condition.

25. A gaming machine, comprising:

a display for displaying a game of chance, said game of chance being played with a plurality of game elements;

a wager input mechanism that registers a wager input by a player, said wager input including registration of an amount bet; and an operating system including a methodology for play of said game of chance, wherein each of said plurality of game elements has a plurality of stop positions with a set of game indicia thereon, wherein the player selects a subset of one or more of said plurality of elements to determine an outcome of said game; and a random selection mechanism randomly selects and displays in each instance a stop position from the entirety of said set of each of said plurality of elements on the display, said methodology determining an outcome of said game based upon combinations of said game indicia of said random stop position of said subset of one or more said plurality of elements and award winnings, if any, per a paytable of winning combinations.

26. The gaming machine of claim 25 wherein said gaming machine is a video gaming machine, said display is a video monitor, and said operating system includes a CPU with a program having said methodology as part of said program, said program further driving said display according to said program, said random selection mechanism comprises a random number generating routine.

27. The gaming machine of claim 26 where said gaming machine is a slot machine and said game elements are reels.

* * * * *